US007063245B2

(12) United States Patent
Faulks et al.

(10) Patent No.: US 7,063,245 B2
(45) Date of Patent: Jun. 20, 2006

(54) SYSTEM FOR DISPENSING PLURALITY OF WET WIPES

(75) Inventors: Michael John Faulks, Neenah, WI (US); Yung Hsiang Huang, Appleton, WI (US); Jennifer Cappel Larson, Oshkosh, WI (US); Steven John Romme, Oshkosh, WI (US); A. Todd Leak, Neenah, WI (US); Paige Annette Dellerman, Appleton, WI (US); Ligia A. Rivera, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 203 days.

(21) Appl. No.: 09/900,359

(22) Filed: Jul. 6, 2001

(65) Prior Publication Data

US 2002/0088815 A1 Jul. 11, 2002

Related U.S. Application Data

(63) Continuation-in-part of application No. 09/841,323, filed on Apr. 24, 2001, now Pat. No. 6,745,975, which is a continuation-in-part of application No. 09/660,040, filed on Sep. 12, 2000, now Pat. No. 6,537,631, which is a continuation-in-part of application No. 09/565,227, filed on May 4, 2000, now Pat. No. 6,705,565.

(51) Int. Cl.
*B26F 3/02* (2006.01)
*B65H 16/06* (2006.01)
*B65H 18/04* (2006.01)

(52) U.S. Cl. ..... 225/40; 225/27; 225/90

(58) Field of Classification Search ..... 225/25, 225/26, 27, 28, 32, 40, 90

See application file for complete search history.

(56) References Cited

U.S. PATENT DOCUMENTS

| | | | | |
|---|---|---|---|---|
| 1,664,392 | A | 4/1928 | Baruch | 242/422.5 |
| 2,004,614 | A | 6/1935 | Meagher | 206/63.5 |
| 2,440,974 | A | 5/1948 | Resch | 312/31 |

(Continued)

FOREIGN PATENT DOCUMENTS

EP 0 020 083 A1 12/1980

(Continued)

OTHER PUBLICATIONS

Derwent World Patent Database Abstract of DE 3133237: Description of M. Scheepe, "Refill Pack of Moisture-Impregnated Tissues".

(Continued)

*Primary Examiner*—Charles Goodman
(74) *Attorney, Agent, or Firm*—Scott A. Baum; Michael J. Bendel

(57) ABSTRACT

There is provided a wet wipes dispensing system. The system includes a plurality of separably joined wet wipes and the plurality of separably joined wet wipes include a lubricant. The system also includes a dispenser including a sealed chamber, the sealed chamber housing the plurality of separably joined wet wipes therein. The dispenser also includes a flexible elastic sealing orifice through which wet wipes from the plurality of separably joined wet wipes can be dispensed from the sealed chamber. At least a portion of the lubricant is automatically transferable to the flexible elastic sealing orifice when wet wipes from the plurality of separably joined wet wipes are dispensed from the sealed chamber through the flexible elastic sealing orifice whereby a drag relationship between the wet wipes and the flexible elastic sealing orifice is reduced by at least about 20%.

28 Claims, 21 Drawing Sheets

U.S. PATENT DOCUMENTS

| | | | | | |
|---|---|---|---|---|---|
| 2,840,266 | A | | 6/1958 | Nelson | 221/48 |
| 2,840,267 | A | | 6/1958 | Nelson | 221/48 |
| 3,095,991 | A | | 7/1963 | Paniagua | 215/303 |
| 3,239,097 | A | | 3/1966 | Bates et al. | 221/48 |
| 3,310,353 | A | | 3/1967 | Cordis | 312/34.4 |
| 3,368,522 | A | | 2/1968 | Cordis | 118/43 |
| 3,369,699 | A | | 2/1968 | Enloe et al. | 221/48 |
| 3,532,210 | A | | 10/1970 | Minion et al. | 206/408 |
| 3,568,635 | A | | 3/1971 | Poitras et al. | 118/122 |
| 3,592,161 | A | | 7/1971 | Hoffmann | 118/122 |
| 3,603,519 | A | | 9/1971 | Brown et al. | 242/594.1 |
| 3,633,838 | A | | 1/1972 | Krueger | 242/597.8 |
| 3,656,699 | A | | 4/1972 | Schnyder et al. | 242/560 |
| 3,713,170 | A | | 1/1973 | Kaufman | 346/136 |
| 3,729,145 | A | | 4/1973 | Koo et al. | 242/596.5 |
| 3,749,296 | A | | 7/1973 | Harrison | 225/106 |
| 3,754,804 | A | | 8/1973 | Cushman | 312/71 |
| 3,756,483 | A | | 9/1973 | Schraeder | 225/52 |
| 3,771,399 | A | * | 11/1973 | Aterianus | 83/348 |
| 3,771,739 | A | | 11/1973 | Nelson | 242/560.3 |
| 3,775,801 | A | | 12/1973 | Walker | 15/104.93 |
| 3,780,908 | A | | 12/1973 | Fitzpatrick et al. | 221/48 |
| 3,784,055 | A | | 1/1974 | Anderson | 221/46 |
| 3,788,573 | A | | 1/1974 | Thomson et al. | 242/423.1 |
| D230,805 | S | | 3/1974 | Howard | D6/584 |
| 3,795,355 | A | | 3/1974 | Gerstein | 225/106 |
| 3,806,055 | A | | 4/1974 | Bauman | 242/597.8 |
| 3,824,953 | A | | 7/1974 | Boone | 118/75 |
| 3,836,044 | A | | 9/1974 | Tilp et al. | 221/55 |
| 3,836,045 | A | | 9/1974 | Duhy et al. | 221/63 |
| 3,837,595 | A | | 9/1974 | Boone | 242/594.5 |
| 3,841,466 | A | | 10/1974 | Hoffman et al. | 206/205 |
| 3,843,017 | A | | 10/1974 | Harrison | 221/63 |
| 3,848,822 | A | | 11/1974 | Boone | 242/590 |
| 3,865,271 | A | | 2/1975 | Gold | 221/96 |
| 3,868,052 | A | * | 2/1975 | Rockefeller | 225/106 |
| 3,890,622 | A | | 6/1975 | Alden | 347/170 |
| 3,913,522 | A | | 10/1975 | Light | 118/419 |
| 3,943,859 | A | | 3/1976 | Boone | 108/27 |
| 3,949,947 | A | | 4/1976 | Youngquist et al. | 242/422.5 |
| 3,967,756 | A | | 7/1976 | Barish | 221/45 |
| 3,970,215 | A | | 7/1976 | McLaren et al. | 221/45 |
| 3,973,695 | A | * | 8/1976 | Ames | 221/63 |
| 3,979,019 | A | | 9/1976 | Bliss | 221/48 |
| 3,982,659 | A | | 9/1976 | Ross | 221/63 |
| 3,986,479 | A | | 10/1976 | Bonk | 118/506 |
| 3,994,417 | A | | 11/1976 | Boedecker | 221/48 |
| 3,995,582 | A | | 12/1976 | Douglas | 118/43 |
| 4,002,264 | A | | 1/1977 | Marchesani | 221/63 |
| 4,004,687 | A | | 1/1977 | Boone | 206/233 |
| 4,017,002 | A | | 4/1977 | Doyle et al. | 221/63 |
| 4,025,004 | A | | 5/1977 | Massey | 242/594.3 |
| 4,043,519 | A | | 8/1977 | Suzuki et al. | 242/596.4 |
| 4,069,789 | A | | 1/1978 | Fukagawa et al. | 118/43 |
| 4,071,200 | A | | 1/1978 | Stone | 242/564 |
| D247,465 | S | | 3/1978 | Ford | D6/523 |
| 4,098,469 | A | | 7/1978 | McCarthy | 242/560.3 |
| 4,101,026 | A | | 7/1978 | Bonk | 206/205 |
| 4,106,433 | A | | 8/1978 | Fernando et al. | 118/212 |
| 4,106,616 | A | | 8/1978 | Boone | 206/233 |
| 4,106,617 | A | | 8/1978 | Boone | 206/233 |
| 4,114,824 | A | | 9/1978 | Danielak | 242/595 |
| 4,124,259 | A | | 11/1978 | Harris | 312/34.22 |
| 4,131,195 | A | | 12/1978 | Worrell, Sr. | 206/205 |
| 4,133,457 | A | | 1/1979 | Klassen | 222/212 |
| 4,135,199 | A | | 1/1979 | Kurland et al. | 347/164 |
| 4,135,678 | A | | 1/1979 | Williams | 242/560.3 |
| 4,138,034 | A | | 2/1979 | McCarthy | 221/48 |
| 4,179,078 | A | | 12/1979 | Mansfield | 242/597.4 |
| 4,180,160 | A | | 12/1979 | Ogawa et al. | 206/210 |
| 4,191,317 | A | | 3/1980 | Harkins | 225/77 |
| 4,200,200 | A | | 4/1980 | Hein, III et al. | 221/48 |
| 4,205,802 | A | | 6/1980 | Economakis | 242/594.5 |
| D256,062 | S | | 7/1980 | Joachim et al. | D7/7 |
| 4,219,129 | A | | 8/1980 | Sedgwick | 221/63 |
| 4,222,621 | A | | 9/1980 | Greenlee et al. | 242/560.3 |
| 4,235,333 | A | | 11/1980 | Boone | 206/233 |
| 4,238,541 | A | * | 12/1980 | Burton | 428/43 |
| 4,244,493 | A | | 1/1981 | Harrison | 221/46 |
| 4,260,117 | A | | 4/1981 | Perrin et al. | 242/564.2 |
| 4,272,473 | A | * | 6/1981 | Riemersma et al. | 264/154 |
| 4,274,573 | A | | 6/1981 | Finkelstein | 225/106 |
| 4,280,978 | A | * | 7/1981 | Dannheim et al. | 264/156 |
| 4,289,262 | A | | 9/1981 | Finkelstein | 225/106 |
| 4,294,389 | A | | 10/1981 | Falk et al. | 225/34 |
| 4,328,907 | A | | 5/1982 | Beard | 221/63 |
| 4,337,876 | A | | 7/1982 | Thompson | 221/36 |
| 4,353,480 | A | | 10/1982 | McFadyen | 221/63 |
| 4,363,454 | A | | 12/1982 | Mohar | 242/560.3 |
| 4,375,874 | A | | 3/1983 | Leotta et al. | 242/560 |
| 4,383,656 | A | | 5/1983 | Campbell | 242/590 |
| 4,401,248 | A | | 8/1983 | Helms | 225/47 |
| 4,411,374 | A | | 10/1983 | Hotchkiss | 221/63 |
| 4,425,012 | A | | 1/1984 | Kley | 312/34.8 |
| 4,427,159 | A | | 1/1984 | Miller et al. | 242/560 |
| 4,428,497 | A | | 1/1984 | Julius et al. | 220/835 |
| 4,432,504 | A | | 2/1984 | Pace | 242/598.1 |
| 4,436,221 | A | | 3/1984 | Margulies | 221/46 |
| 4,447,015 | A | | 5/1984 | Peterson | 242/599.1 |
| 4,453,634 | A | | 6/1984 | Blumenthal | 206/389 |
| 4,463,912 | A | | 8/1984 | Grunerud | 242/560.2 |
| 4,467,974 | A | | 8/1984 | Crim | 242/419.4 |
| 4,526,291 | A | | 7/1985 | Margulies | 221/63 |
| 4,535,912 | A | | 8/1985 | Bonk | 221/46 |
| 4,550,855 | A | | 11/1985 | Harrison | 221/63 |
| 4,562,938 | A | | 1/1986 | Loder | 221/46 |
| 4,564,148 | A | | 1/1986 | Wentworth | 242/560.3 |
| 4,566,606 | A | | 1/1986 | Kling | 221/25 |
| 4,570,820 | A | | 2/1986 | Murphy | 221/34 |
| 4,586,630 | A | | 5/1986 | Loder | 221/46 |
| 4,586,631 | A | | 5/1986 | Loder | 221/58 |
| 4,607,809 | A | | 8/1986 | Sineni et al. | 242/560 |
| 4,648,530 | A | | 3/1987 | Granger | 221/34 |
| 4,651,895 | A | | 3/1987 | Niske et al. | 221/63 |
| 4,659,028 | A | | 4/1987 | Wren | 242/596.8 |
| 4,662,576 | A | | 5/1987 | Paul | 242/596.4 |
| 4,662,577 | A | | 5/1987 | Lewis | 242/558 |
| 4,667,890 | A | | 5/1987 | Gietman, Jr. | 242/532.2 |
| 4,681,240 | A | | 7/1987 | Wyant | 221/48 |
| 4,684,075 | A | | 8/1987 | Francis | 242/422.5 |
| 4,687,153 | A | * | 8/1987 | McNeil | 242/521 |
| 4,690,345 | A | | 9/1987 | Cotey | 242/601.5 |
| 4,721,264 | A | | 1/1988 | Muscarello | 242/598.6 |
| 4,735,317 | A | | 4/1988 | Sussman et al. | 206/449 |
| 4,756,485 | A | | 7/1988 | Bastian et al. | 242/560.1 |
| 4,784,290 | A | | 11/1988 | Howard | 221/63 |
| 4,790,490 | A | | 12/1988 | Chakravorty | 242/564.1 |
| 4,807,823 | A | | 2/1989 | Wyant | 242/560 |
| 4,826,063 | A | | 5/1989 | Ban | 225/52 |
| 4,828,193 | A | | 5/1989 | Galbraith | 225/80 |
| 4,830,301 | A | | 5/1989 | Miller | 242/560.3 |
| 4,834,316 | A | | 5/1989 | DeLorean | 242/594.5 |
| 4,836,368 | A | | 6/1989 | Cotton | 206/205 |
| 4,836,462 | A | | 6/1989 | Bruss | 242/598.2 |
| 4,846,412 | A | | 7/1989 | Morand | 242/560.1 |
| 4,848,575 | A | | 7/1989 | Nakamura et al. | 206/449 |
| 4,860,893 | A | | 8/1989 | Kaufman | 206/390 |
| D303,890 | S | | 10/1989 | Pilot | D6/523 |
| 4,877,133 | A | | 10/1989 | Klenter et al. | 206/416 |
| 4,883,197 | A | | 11/1989 | Sanchez et al. | 221/26 |
| 4,884,690 | A | | 12/1989 | Klenter et al. | 206/416 |
| 4,890,205 | A | | 12/1989 | Shaffer | 362/154 |
| 4,913,365 | A | | 4/1990 | Shamass | 242/591 |
| 4,936,452 | A | | 6/1990 | Pauley | 242/588.6 |

4,940,626 A 7/1990 Rhodes, III et al. ..... 428/198
D311,106 S 10/1990 Jaber ..... D6/520
4,978,095 A 12/1990 Phillips ..... 248/312
4,984,530 A 1/1991 Dutton ..... 118/43
4,989,800 A 2/1991 Tritch ..... 242/560.2
4,991,538 A 2/1991 Davids et al. ..... 118/231
5,000,393 A 3/1991 Madsen ..... 242/560
5,001,956 A * 3/1991 Nitsch ..... 83/620
5,009,313 A 4/1991 Morand ..... 206/391
D316,787 S 5/1991 Kelly ..... D6/515
5,012,986 A 5/1991 Needle ..... 242/597.6
5,029,787 A 7/1991 Florentin ..... 248/206.3
5,050,737 A 9/1991 Joslyn et al. ..... 206/494
5,054,676 A 10/1991 Ban ..... 225/42
5,070,171 A 12/1991 O'Lenick, Jr. ..... 528/33
5,104,054 A 4/1992 Latham ..... 242/595
5,114,771 A * 5/1992 Ogg et al. ..... 428/43
5,137,173 A 8/1992 Hughes et al. ..... 221/34
5,141,171 A 8/1992 Yang ..... 242/593
5,145,091 A 9/1992 Meyers ..... 221/45
5,149,765 A 9/1992 O'Lenick, Jr. ..... 528/25
D329,978 S 10/1992 Ryan ..... D9/415
5,154,496 A 10/1992 Campbell et al. ..... 312/34.8
5,170,958 A 12/1992 Brown ..... 242/419.4
5,172,840 A 12/1992 Bloch et al. ..... 225/37
D332,875 S 2/1993 Shufelt et al. ..... D5/53
5,192,044 A 3/1993 Baskin ..... 242/560
5,193,759 A 3/1993 Bigelow et al. ..... 242/348.4
5,195,689 A 3/1993 Beer et al. ..... 242/588.6
5,207,367 A 5/1993 Dunn et al. ..... 225/49
5,219,092 A 6/1993 Morand ..... 221/53
5,228,632 A 7/1993 Addison et al. ..... 242/588.2
5,235,017 A 8/1993 O'Lenick, Jr. ..... 528/26
5,237,035 A 8/1993 O'Lenick, Jr. et al. ..... 528/27
D339,262 S 9/1993 McClure ..... D6/609
5,253,818 A 10/1993 Craddock ..... 242/596.4
5,255,800 A 10/1993 Kelly ..... 211/89.01
5,260,401 A 11/1993 O'Lenick, Jr. ..... 528/26
D342,635 S 12/1993 Carter et al. ..... D6/518
D342,852 S 1/1994 Welch ..... D6/520
5,277,375 A 1/1994 Dearwester ..... 242/596.7
5,310,262 A 5/1994 Robison et al. ..... 383/205
5,311,986 A 5/1994 Putz ..... 206/833
5,312,883 A 5/1994 Komatsu et al. ..... 526/318.44
5,316,177 A 5/1994 Boldt ..... 221/63
5,317,063 A 5/1994 Komatsu et al. ..... 525/330.2
D347,534 S 6/1994 Gottselig ..... D6/522
5,335,811 A 8/1994 Morand ..... 221/45
5,368,157 A 11/1994 Gasparrini et al. ..... 206/209
D353,053 S 12/1994 Arnone ..... D5/53
5,370,336 A 12/1994 Whittington ..... 242/560.2
5,374,008 A 12/1994 Halvorson et al. ..... 242/598.3
5,384,189 A 1/1995 Kuroda et al. ..... 442/352
5,392,945 A 2/1995 Syrek ..... 220/608
5,400,982 A 3/1995 Collins ..... 242/560
5,409,181 A 4/1995 Patrick ..... 242/596.2
5,411,729 A 5/1995 O'Lenick, Jr. ..... 424/70.12
5,439,521 A 8/1995 Rao ..... 118/415
5,443,084 A 8/1995 Saleur ..... 134/58 R
D361,895 S 9/1995 Arnone et al. ..... D5/53
D362,121 S 9/1995 Nugent et al. ..... D5/53
5,449,127 A 9/1995 Davis ..... 242/560
D362,773 S 10/1995 Kartchner ..... D6/523
5,456,420 A 10/1995 Frazier ..... 242/564.1
5,456,421 A 10/1995 Reed ..... 242/598.2
5,464,096 A 11/1995 Hurwitz ..... 206/494
5,464,170 A 11/1995 Mitchell et al. ..... 242/598
5,480,060 A 1/1996 Blythe ..... 221/63
5,494,250 A 2/1996 Chen ..... 248/316.7
5,495,997 A 3/1996 Moody ..... 242/561
5,501,323 A 3/1996 Denesha et al. ..... 206/278
5,509,593 A 4/1996 Bloch et al. ..... 225/37
5,516,001 A 5/1996 Muckenfuhs et al. ..... 221/63
5,520,308 A 5/1996 Berg, Jr. et al. ..... 221/50
5,526,973 A 6/1996 Boone et al. ..... 225/34
5,533,621 A 7/1996 Schoal, Jr. ..... 206/409
5,540,332 A 7/1996 Kopacz et al. ..... 206/494
5,542,567 A 8/1996 Julius ..... 221/63
5,542,568 A 8/1996 Julius ..... 221/63
D373,276 S 9/1996 Omdoll et al. ..... D6/520
5,560,514 A 10/1996 Frazier ..... 221/63
5,562,964 A * 10/1996 Jones ..... 428/43
5,566,873 A 10/1996 Guido ..... 225/106
5,582,294 A 12/1996 Yamada ..... 206/494
5,588,615 A 12/1996 Batts ..... 242/598.3
D377,284 S 1/1997 Farrow et al. ..... D6/519
5,598,987 A 2/1997 Wachowicz ..... 242/597.8
5,604,992 A 2/1997 Robinson ..... 34/90
5,605,250 A 2/1997 Meiron et al. ..... 221/33
5,609,269 A 3/1997 Behnke et al. ..... 221/48
5,618,008 A 4/1997 Dearwester et al. ..... 242/594.5
5,620,148 A 4/1997 Mitchell ..... 242/160.4
5,622,281 A 4/1997 Annand ..... 221/48
5,624,025 A 4/1997 Hixon ..... 206/233
5,630,526 A 5/1997 Moody ..... 221/45
5,630,563 A 5/1997 Meisner et al. ..... 242/598.6
5,631,317 A 5/1997 Komatsu et al. ..... 524/561
5,642,810 A 7/1997 Warner et al. ..... 206/389
5,649,676 A 7/1997 Lord ..... 242/595
D381,851 S 8/1997 Sharpe ..... D6/523
5,653,403 A 8/1997 Ritchey ..... 242/597.5
5,655,661 A 8/1997 Rigby ..... 206/557
5,660,313 A 8/1997 Newbold ..... 225/42
5,660,636 A 8/1997 Shangold et al. ..... 118/500
D383,310 S 9/1997 Springer ..... D5/37
5,667,092 A 9/1997 Julius et al. ..... 220/259.1
5,669,576 A 9/1997 Moody ..... 242/560.3
5,672,206 A 9/1997 Gorman ..... 118/320
D386,025 S 11/1997 Mervar et al. ..... D6/520
5,687,875 A 11/1997 Watts et al. ..... 221/45
D387,590 S 12/1997 Cameron et al. ..... D6/523
5,697,576 A 12/1997 Bloch et al. ..... 242/596.8
5,697,577 A 12/1997 Ogden ..... 242/598.6
5,699,912 A 12/1997 Ishikawa et al. ..... 206/494
5,704,471 A 1/1998 Yamada ..... 206/207
5,704,565 A 1/1998 Cheng ..... 242/560.2
5,704,566 A 1/1998 Schutz et al. ..... 242/595
5,727,458 A * 3/1998 Schulz ..... 101/24
5,755,654 A * 5/1998 Schulz et al. ..... 493/350
5,765,717 A 6/1998 Gottselig ..... 221/45
D395,952 S 7/1998 Buczwinski et al. ..... D3/294
5,785,179 A 7/1998 Buczwinski et al. ..... 206/494
D396,636 S 8/1998 Wilfong, Jr. ..... D9/447
D397,265 S 8/1998 Badillo ..... D6/520
5,839,688 A * 11/1998 Hertel et al. ..... 242/523.1
RE35,976 E 12/1998 Gasparrini et al. ..... 206/209
5,848,762 A 12/1998 Reinheimer et al. ..... 242/595
5,868,275 A 2/1999 Moody ..... 221/33
5,868,335 A 2/1999 Lebrun ..... 242/560.3
5,868,344 A 2/1999 Melnick ..... 242/591
5,868,345 A 2/1999 Beisser ..... 242/592
5,868,346 A 2/1999 Cobos ..... 242/593
5,868,347 A 2/1999 Paul et al. ..... 242/596.4
5,875,985 A 3/1999 Cohen et al. ..... 242/160.4
5,887,759 A 3/1999 Ayigbe ..... 222/192
5,887,818 A 3/1999 Kelley ..... 242/559.3
5,893,531 A 4/1999 Taylor et al. ..... 242/598.6
5,897,074 A 4/1999 Marino ..... 242/594.1
D409,086 S 5/1999 Brown et al. ..... D9/428
5,901,921 A 5/1999 Perlsweig ..... 242/597
5,904,316 A 5/1999 Dunning et al. ..... 242/595
5,914,177 A 6/1999 Smith, III et al. ..... 428/195.1
5,924,617 A 7/1999 LaCount et al. ..... 225/16
D412,439 S 8/1999 Cormack ..... D9/425
5,938,013 A 8/1999 Palumbo et al. ..... 206/210
5,950,960 A 9/1999 Marino ..... 242/594.5

| | | | | |
|---|---|---|---|---|
| 5,951,762 | A | 9/1999 | Shangold et al. | 118/405 |
| 5,958,187 | A | 9/1999 | Bhat et al. | 162/125 |
| D414,637 | S | 10/1999 | Amundson et al. | D6/518 |
| 5,964,351 | A | 10/1999 | Zander | 206/494 |
| 5,967,452 | A | 10/1999 | Wilder | 242/597.4 |
| 5,971,138 | A | 10/1999 | Soughan | 206/210 |
| 5,971,142 | A | 10/1999 | Jones | 206/233 |
| D416,794 | S | 11/1999 | Cormack | D9/425 |
| D417,109 | S | 11/1999 | Johnson et al. | D6/518 |
| 5,979,821 | A | 11/1999 | LaCount et al. | 242/560.1 |
| 5,992,718 | A | 11/1999 | Zaranek | 224/311 |
| D417,987 | S | 12/1999 | Velazquez | D6/520 |
| D418,059 | S | 12/1999 | Hill | D9/434 |
| 6,000,538 | A | 12/1999 | Lee | 206/233 |
| 6,000,658 | A | 12/1999 | McCall, Jr. | 242/599 |
| 6,007,019 | A | 12/1999 | Lynch | 242/598.2 |
| 6,010,001 | A | 1/2000 | Osborn, III | 206/440 |
| 6,015,125 | A | 1/2000 | Fischer | 248/231.9 |
| 6,024,216 | A | 2/2000 | Shillington et al. | 206/366 |
| 6,024,217 | A | 2/2000 | Ponsi et al. | 206/370 |
| 6,024,323 | A | 2/2000 | Palerno, Jr. | 242/588.6 |
| 6,029,921 | A * | 2/2000 | Johnson | 242/160.1 |
| D421,691 | S | 3/2000 | Hoblitz | D6/522 |
| 6,036,134 | A | 3/2000 | Moody | 242/422.4 |
| D422,437 | S | 4/2000 | Conran et al. | D6/518 |
| 6,047,920 | A | 4/2000 | Dearwester et al. | 242/594.5 |
| 6,053,357 | A | 4/2000 | Yoh | 221/63 |
| 6,056,233 | A | 5/2000 | Von Schenk | 242/594.5 |
| 6,056,235 | A | 5/2000 | Brozinsky | 242/598.6 |
| 6,059,882 | A | 5/2000 | Steinhardt et al. | 118/264 |
| 6,059,928 | A | 5/2000 | Van Luu et al. | 162/111 |
| 6,068,118 | A | 5/2000 | Calloway | 206/233 |
| 6,070,821 | A | 6/2000 | Mitchell | 242/160.4 |
| 6,079,603 | A | 6/2000 | Smegal | 225/1 |
| 6,082,664 | A | 7/2000 | Phelps et al. | 242/596.5 |
| 6,085,899 | A | 7/2000 | Thorsbakken | 206/205 |
| 6,092,690 | A | 7/2000 | Bitowft et al. | 220/831 |
| 6,092,758 | A | 7/2000 | Gemmell | 242/596.4 |
| 6,092,759 | A | 7/2000 | Gemmell et al. | 242/596.8 |
| D429,282 | S | 8/2000 | Velazquez et al. | D20/11 |
| 6,098,836 | A | 8/2000 | Gottselig | 221/45 |
| 6,121,165 | A | 9/2000 | Mackey et al. | 442/84 |
| 6,138,867 | A | 10/2000 | Stelmack | 221/63 |
| 6,138,939 | A | 10/2000 | Phelps et al. | 242/596.7 |
| 6,152,322 | A | 11/2000 | Marino | 221/63 |
| 6,158,614 | A | 12/2000 | Haines et al. | 221/63 |
| 6,164,442 | A | 12/2000 | Stravitz | 206/233 |
| 6,228,454 | B1 | 5/2001 | Johnson et al. | 428/43 |
| D443,450 | S | 6/2001 | Ruhotas et al. | D6/515 |
| D445,028 | S | 7/2001 | Grubstein | D9/447 |
| 6,273,359 | B1 | 8/2001 | Newman et al. | 242/595 |
| 6,550,634 | B1 | 4/2003 | Alegre De Miguel et al. | |

FOREIGN PATENT DOCUMENTS

| | | | |
|---|---|---|---|
| EP | 0 110 473 | A1 | 6/1984 |
| EP | 0 122 809 | A1 | 10/1984 |
| EP | 0 068 722 | B1 | 4/1988 |
| EP | 0 343 304 | A2 | 11/1989 |
| EP | 0 251 103 | B1 | 2/1990 |
| EP | 0 331 027 | B1 | 1/1992 |
| EP | 0 501 905 | A1 | 9/1992 |
| EP | 0 644 130 | A1 | 3/1995 |
| EP | 0 728 426 | A1 | 8/1996 |
| EP | 0 744 357 | A1 | 11/1996 |
| EP | 0 796 728 | A2 | 9/1997 |
| EP | 0 608 460 | B1 | 9/1998 |
| EP | 0 895 956 | A1 | 2/1999 |
| EP | 0 930 243 | A1 | 7/1999 |
| EP | 0 952 088 | A1 | 10/1999 |
| EP | 0 953 516 | A1 | 11/1999 |
| EP | 1 002 746 | A1 | 5/2000 |
| EP | 1 048 257 | A1 | 11/2000 |
| EP | 1 072 534 | A1 | 1/2001 |
| GB | 793745 | | 4/1958 |
| GB | 990332 | | 4/1965 |
| GB | 1 324 818 | | 7/1973 |
| GB | 2 308 114 | A | 6/1997 |
| WO | WO 93/17933 | A1 | 9/1993 |
| WO | WO 96/21388 | A1 | 7/1996 |
| WO | WO 97/39964 | A1 | 10/1997 |
| WO | WO 98/08763 | A1 | 3/1998 |
| WO | WO 98/19946 | A1 | 5/1998 |
| WO | WO 98/34781 | A1 | 8/1998 |
| WO | WO 99/01536 | A1 | 1/1999 |
| WO | WO 99/06311 | A2 | 2/1999 |
| WO | WO 99/55599 | A1 | 11/1999 |
| WO | WO 00/00071 | A1 | 1/2000 |
| WO | WO 00/08998 | A1 | 2/2000 |
| WO | WO 00/30956 | A1 | 6/2000 |
| WO | WO 00/38751 | A1 | 7/2000 |
| WO | WO 00/57843 | A2 | 10/2000 |
| WO | WO 00/65972 | A1 | 11/2000 |
| WO | WO 00/65973 | A1 | 11/2000 |
| WO | WO 01/17496 | A1 | 3/2001 |
| WO | WO 01/41613 | A1 | 6/2001 |
| WO | WO 01/74687 | A1 | 10/2001 |
| WO | WO 01/74694 | A1 | 10/2001 |

OTHER PUBLICATIONS

Derwent World Patent Database abstract of JP 07-284,461 A: Description of Kusunoki N (KUSU-I), "Toilet Paper Holder", and Patent Abstracts of Japan JP 07-284,461: Description of Kusunoki Nobuaki, "Toilet Paper-Holder Allowing Taking Out Paper Thereof With One Hand".

Derwent World Patent Database abstract of JP 00-085,782 A: Description of Pigeon KK (PIGE-N), "Paper Holder For Wet Tissues Used In Toilets," and Patent Abstracts of Japan JP 00-085,782: Description of Watanabe Kuniko et al., "Paper Holder".

Kotler, Philip, *Marketing Management*, Prentice Hall, Upper Saddle River, NJ, 2000, p. 456-483.

Images of Moist Mates product—dispenser and wipes, approximately 1996, 15 Pages.

Images of Moist Mates product—dispenser and wipes, approximately 2000, 13 Pages.

Images of Moist Mates product—refill wipes, approximately 2000, 11 Pages.

Images of Fresh & Clean product—wet toilet paper, approximately Sep. 2000, 3 Pages.

Gottselig, Letter, dated Apr. 4, 1998, and accompanying drawings.

American Society for Testing Materials (ASTM) Designation: D 395-95, "Standard Test Methods for U-Bend Seamless Copper and Copper Alloy Heat Exchanger and Condenser Tubes", pp. 535-543, published Oct. 1995.

American Society for Testing Materials (ASTM) Designation: D 1117-80, "Standard Test Methods of Testing Nonwoven Fabrics," pp. 240-246, published May 1980.

American Society for Testing Materials (ASTM) Designation: D 2240-97, "Standard Test Method for Rubber Property—Durometer Hardness," pp. 400-403, published Mar. 1997.

American Society for Testing Materials (ASTM) Designation: D 412-98a, "Standard Test Methods for Vulcanized Rubber and Thermoplastic Elastomers—Tension," pp. 43-55, published Aug. 1988.

American Society for Testing Materials (ASTM) Designation: D 6125-97, "Standard Test Method for Bending Resistance of Paper and Paperboard (Gurley Type Tester)," pp. 885-889, published Feb. 1998.

American Society for Testing Materials (ASTM) Designation: D 624-98, "Standard Test Methods for Tear Strength of Conventional Vulcanized Rubber and Thermoplastic Elastomers", pp. 132-140, published Apr. 1998.
American Society for Testing Materials (ASTM) Designation: D 790-99, "Standard Test Methods for Flexural Properties of Unreinforced and Reinforced Plastics and Electrical Insulating Materials", pp. 150-158, published Feb. 2000.
American Society for Testing Materials (ASTM) Designation: D 792-98, "Standard Test Methods for Density and Specific Gravity (Relative Density) of Plastics by Displacement", pp. 159-163, published Nov. 1998.

* cited by examiner

SYSTEM FOR DISPENSING PLURALITY OF WET WIPES

This application is a continuation in part of U.S. application entitled "SYSTEM FOR DISPENSING PLURALITY OF WET WIPES," Ser. No. 09/841,323 filed Apr. 24, 2001, now U.S. Pat. No. 6,745,975 which is a continuation in part of U.S. application entitled "ROLL OF WET WIPES," Ser. No. 09/660,040 filed Sep. 12, 2000, now U.S. Pat. No. 6,537,631 which is a continuation in part of U.S. application entitled "SYSTEM AND DISPENSER FOR DISPENSING WET WIPES", Ser. No. 09/565,227, filed May 4, 2000, now U.S. Pat. No. 6,705,565 the disclosures of which are hereby incorporated by reference.

BACKGROUND OF THE INVENTION

Wet products such as wet wipes have many applications. They may be used with small children and infants when changing diapers, they may be used for household cleaning tasks, they may be used for cleaning hands, they may be used as a bath tissue, they may be used as by a caregiver to clean a disabled or incontinent adult, or they may be used in and for a whole host of other applications, where it is advantageous to have a wipe or towel that has some wetness or moisture in it.

Wet wipes have been traditionally dispensed in sheet form from a tub like container with a hinged lid on the top. The lid is opened and individual or singularized sheets of the wipes are removed. Another type of container that has been used for wet wipes provides a roll of wipes in which the wipes are pulled from the top of the container in a direction that is parallel to the axis of the roll. These wipes are pulled from the center of a hollow coreless roll that has perforated sheets. These containers generally have a snap top lid that is opened to expose a piece of the wipes that can then be pulled to remove the desired amount of wipes. Once pulled out the wipes can then be torn off, usually at a perforation, and the lid closed.

Wet wipes can be any wipe, towel, tissue or sheet like product including natural fibers, synthetic fibers, synthetic material and combinations thereof, that is wet or moist or becomes wet prior to use. Wet wipes may be dispersible when in contact with water or may be non-dispersible. Examples of wet wipes are disclosed in application Ser. Nos. 09/564,449; 09/564,213; 09/565,125; 09/564,837; 09/564,939; 091564,531; 09/564,268; 09/564,424; 09/564,780; 09/564,212; 09/565,623 all filed May 4, 2000, and application Ser. No. 09/223,999 entitled Ion-Sensitive Hard Water Dispersible Polymers And Applications Therefore, filed Dec. 31, 1998, the disclosures of which are incorporated herein by reference. Embodiments of dispensers are described in U.S. application Ser. No. 09/659,307, entitled "WET WIPES" filed Sep. 12, 2000, the disclosure of which is incorporated herein by reference.

Dispensing a plurality of wet wipes is desirable and advantageous for perineal cleaning. Similar to conventional dry toilet tissue usage, users want control and discretion over the number of separable sheets at their disposal. Dispensing a single sheet at a time can be undesirable to the user and can complicate the use of wet wipes designed for perineal cleaning. Thus, there is a need for a wet wipes dispensing system that is more like a dry toilet tissue dispensing system, and yet also takes into account unique requirements of wet wipes (e.g., moisture retention, wet product dispensing).

SUMMARY OF THE INVENTION

The dispensing of a plurality of wet wipes, and particularly for a perforated roll, works better if particular dispensing characteristics are present. For example, this can be due, at least in part, to the physical properties of the plurality of wipes. As another example, this can be due, at least in part, to the dispenser container from which the wipes are dispensed and properties thereof.

In response to a desire to enhance the dispensing of a plurality of wipes, for example, particular dispensing characteristics have been discovered and quantified. The purposes and features of the present invention will be set forth in and are apparent from the description that follows, as well as will be learned by practice of the invention. Additional features of the invention will be realized and attained by the product and processes particularly pointed out in the written description and claims hereof, as well as from the appended drawings.

In an aspect of the invention, there is provided a wet wipes dispensing system. The system includes a plurality of separably joined wet wipes and the plurality of separably joined wet wipes include a lubricant. The system also includes a dispenser including a sealed chamber, the sealed chamber housing the plurality of separably joined wet wipes therein. The dispenser also includes a flexible elastic sealing orifice through which wet wipes from the plurality of separably joined wet wipes can be dispensed from the sealed chamber. At least a portion of the lubricant is automatically transferable to the flexible elastic sealing orifice when wet wipes from the plurality of separably joined wet wipes are dispensed from the sealed chamber through the flexible elastic sealing orifice whereby a drag relationship between the wet wipes and the flexible elastic sealing orifice is reduced by at least about 20%.

In another aspect of the invention, there is provided a system for dispensing a plurality of wet wipes upon a single occasion. The system includes a roll of a plurality of separably joined wet wipes moistened with a solution containing a lubricant. A dispenser houses the roll therein and includes a flexible elastic sealing orifice through which a plurality of wet wipes of the roll can be dispensed upon a single occasion from the dispenser. Dispensing the plurality of wet wipes through the flexible elastic sealing orifice automatically lubricates the flexible elastic sealing orifice with the lubricant whereby a drag relationship between the plurality of wet wipes and the flexible elastic sealing orifice is reduced by at least about 20%.

In yet another aspect of the invention, there is provided a method for dispensing a plurality of wet wipes upon a single occasion. The method includes providing a plurality of separably joined wipes moistened with a solution containing a lubricant; storing the plurality of separably joined wipes in a dispenser; dispensing a plurality of wet wipes from the plurality of separably joined wipes upon a single occasion through a flexible elastic sealing orifice of the dispenser; and automatically lubricating the orifice of the dispenser with the lubricant when dispensing the plurality of wet wipes and thereby reducing a drag relationship between the plurality of wet wipes and the flexible elastic sealing orifice by at least about 20%.

In still other aspects of the invention, there are provided desired and more desired ranges relating to characteristics of wipes used in combination with a dispenser, as well as relating to characteristics of dispensers and components thereof.

As used herein, wet wipes of the invention are considered "separably joined", "separably joining" (and variations thereof) when each wipe of a plurality, e.g., in a roll or stack of wipes, is engaging any adjacent wipe while in the dispenser or package such that withdrawing the leading wipe through the dispenser or package opening also withdraws at least a portion of the following wipe through the opening before the leading wipe and the following wipe can be separated completely from each other. Such engaging of any adjacent wipe can include a non-interfolded relationship in combination with one or more of the following between adjacent wipes: adhesive, friction, cohesion, fusion bonding (e.g., ultrasonic welding, heat sealing), mechanical entanglement (e.g., needle punching, steam sealing, embossing, crimping), autogeneous bonding, and/or weakened line(s) (e.g., perforations, zones of frangibility, score line(s), crush cutting).

As used herein, "wet wipe(s)" means wipe(s) which contain(s) a solution add-on between 25% and the maximum add-on which can be accepted by the wipe(s) (i.e. saturation). The wetting solution add-on can be between, in order of increasing advantage, about 25% and 700%; between 50% and 400%; between 100% and 350%; between 150% and 300%; or, between 200% and 250%. The amount of liquid or wetting solution contained within a given wet wipe can vary depending on factors including the type of basesheet, the type of liquid or solution being used, the wetting conditions employed, the type of container used to store the wet wipes, and the intended end use of the wet wipes. To determine the liquid add-on, first the weight of a portion of dry wipe having specific dimensions is determined. Then, the amount of liquid by weight equal to a multiple (e.g. 1, 1.5, 2.5, 3.3, etc., times) where 1=100%, 2.5=250%, etc., of the portion of the dry wipe, or an increased amount of liquid measured as a percent add-on based on the weight of the dry wipe portion, is added to the wipe to make it moistened, and then referred to as a "wet wipe".

As used herein, "lubricant" means any substance carried by the wetting solution for wetting the wet wipes and which substance is capable of reducing friction between two adjacent solid surfaces moving across one another. For example, for wet wipes the reduction in friction equates to less drag force between wet wipes and a dispenser when dispensing wet wipes from the dispenser.

As used herein, "flexible elastic sealing orifice" means an orifice or opening of a dispenser for wet wipes through which wet wipes are dispensed where the orifice or opening assists in sealing the wet wipes within the dispenser from an environment outside of the dispenser (housing or chamber) and where at least a portion of the orifice through which wet wipes are dispensed has the following flexibility and elasticity characteristics: an elastic modulus value (measured by 300% modulus (ASTM D 412)) between 50 psi and 1000 psi and a Gurley stiffness value (ASTM D 6125-97) between 100 milligrams of force (mgf) and 8000 mgf.

As used herein, when the following wipe that has at least a portion through the opening of the dispenser or package is intentionally maintained in the opening after the leading wipe is completely separated from the following wipe, this is referred to as "pop-up" format or dispensing. To be intentionally maintained in the opening means the opening is configured to so maintain the wipe therein, such as through use of a constricting orifice or opening being smaller than the wipe in at least one dimension of the wipe.

As used herein, the term "rigid" is used to mean a level of stiffness commonly associated with materials used to manufacture wet wipes tubs. Numerically, these materials typically have a flexural modulus (as measured in accordance with ASTM D790 "Standard Test Method for Flexural Properties of Unreinforced and Reinforced Plastics and Electrical Insulating Materials" ) of about 500 Newtons per square millimeter or greater, more specifically from about 1100 to about 1550 Newtons per square millimeter.

It is to be understood that both the foregoing general description and the following detailed description are exemplary and are intended to provide further explanation of the invention claimed. The accompanying drawings, which are incorporated in and constitute part of this specification, are included to illustrate and provide a further understanding of the wipes of the invention. Together with the description, the drawings serve to explain the various aspects of the invention.

DRAWINGS

The present invention will be more fully understood and further features will become apparent when reference is made to the following detailed description of the invention and the accompanying drawings. The drawings are merely representative and are not intended to limit the scope of the claims. Like parts depicted in the drawings are referred to by the same reference numerals.

Figure 1:
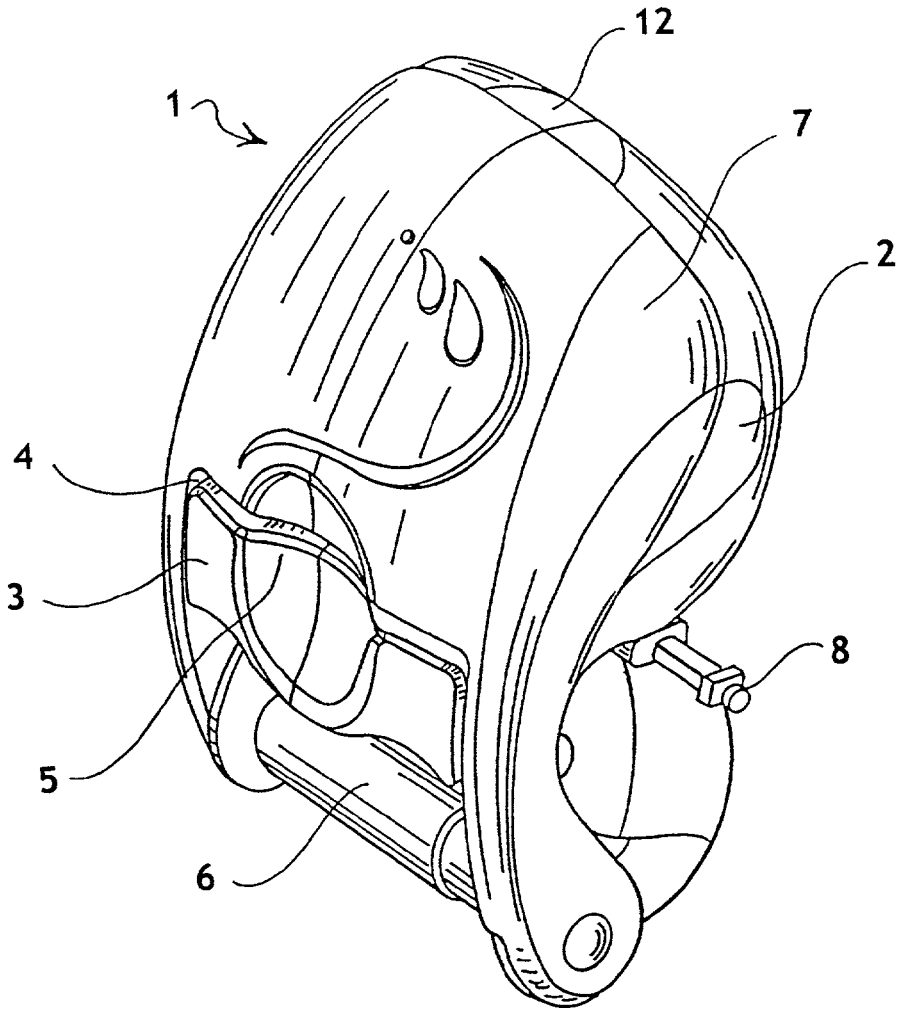
FIG. 1 is a perspective view of a dispenser.
Figure 2A:
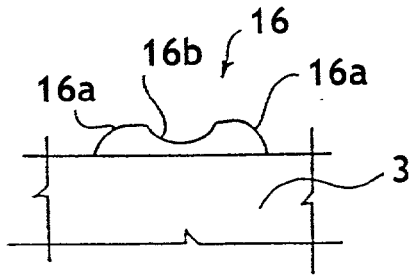
FIG. 2 is an exploded view of the dispenser of FIG. 1.

FIG. 2*a* is a plan view of a portion of the front of a tray of the dispenser of FIG. 1.

Figure 3:
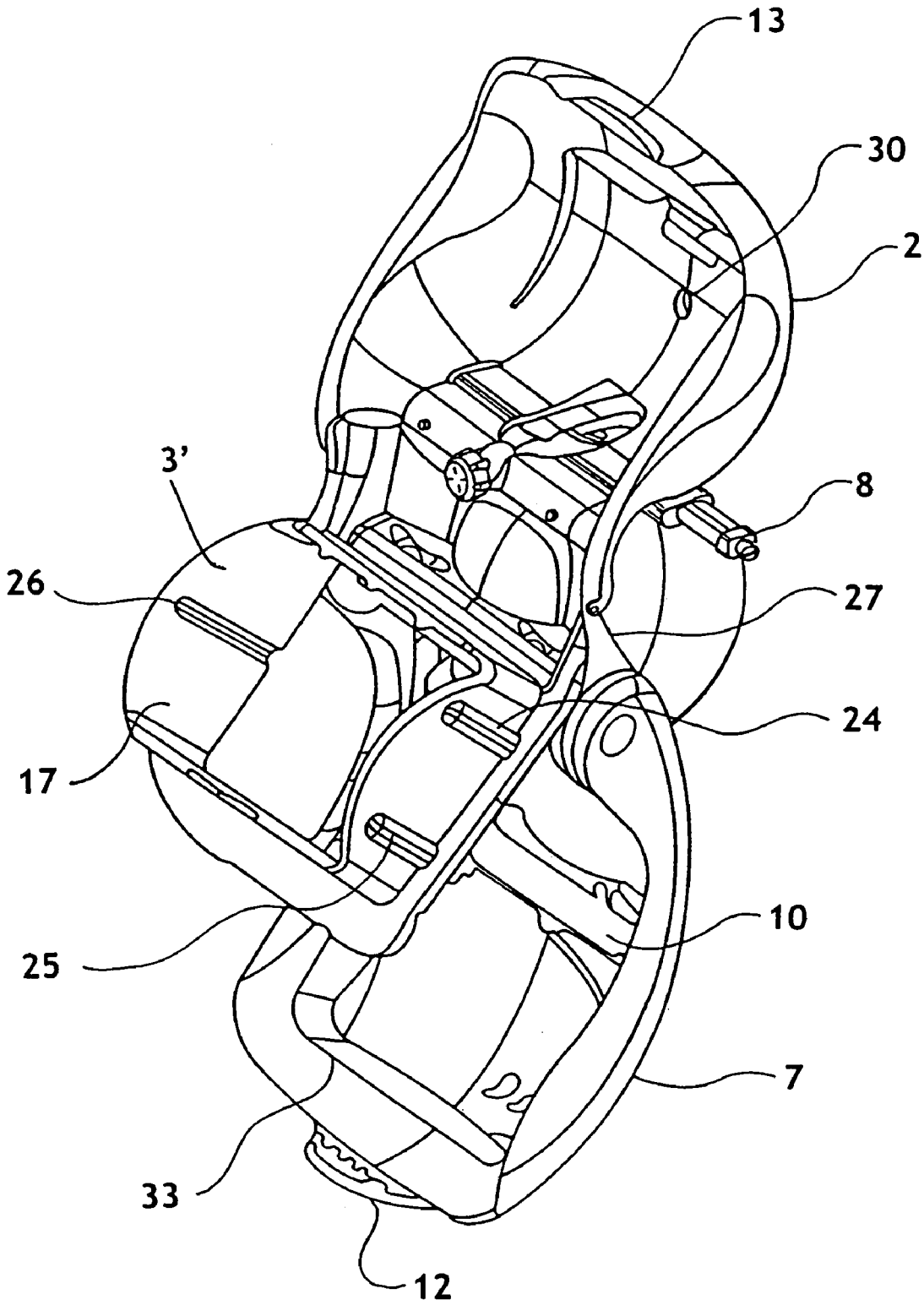

FIG. 3 is a perspective view of the dispenser of FIG. 1, in an open position.

Figure 4:
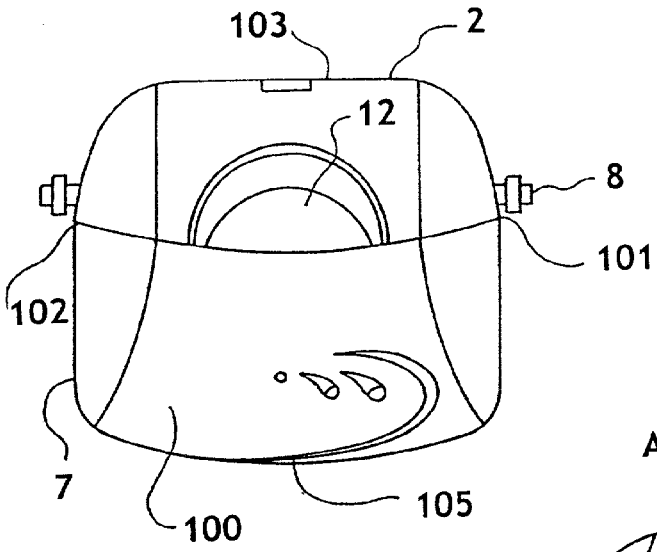

FIG. 4 is a top view of the dispenser of FIG. 1.

Figure 4A:
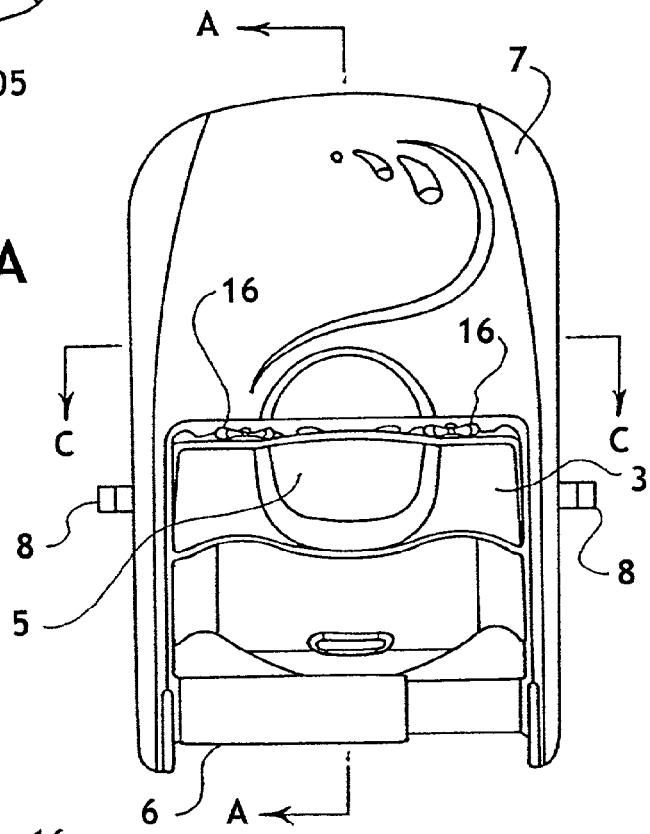

FIG. 4A is a front view of the dispenser of FIG. 1

Figure 4B:
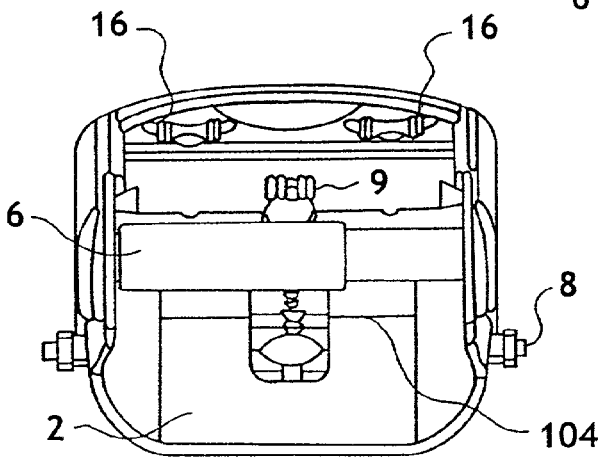

FIG. 4B is a bottom view of the dispenser of FIG. 1.

Figure 2:
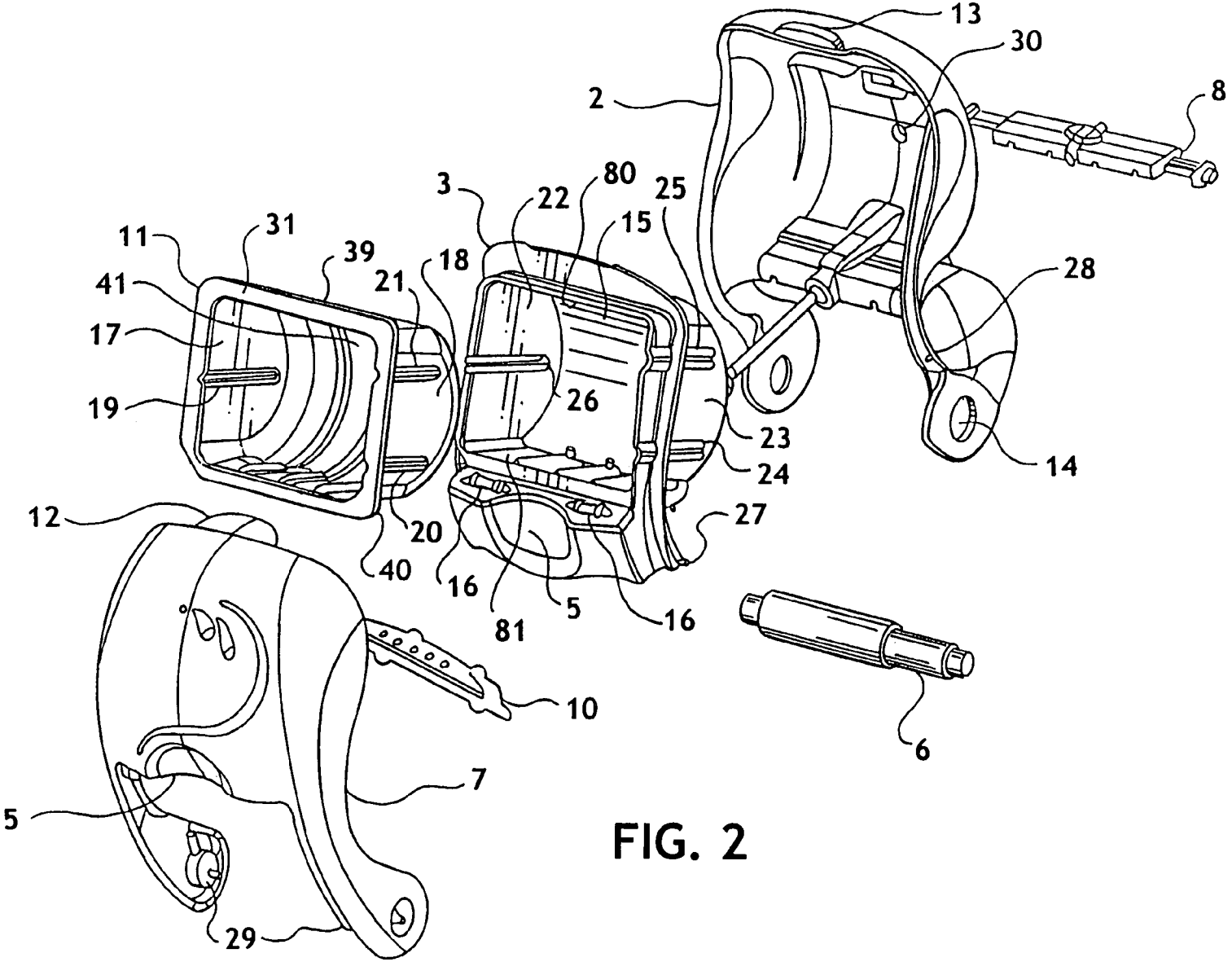
Figure 5:
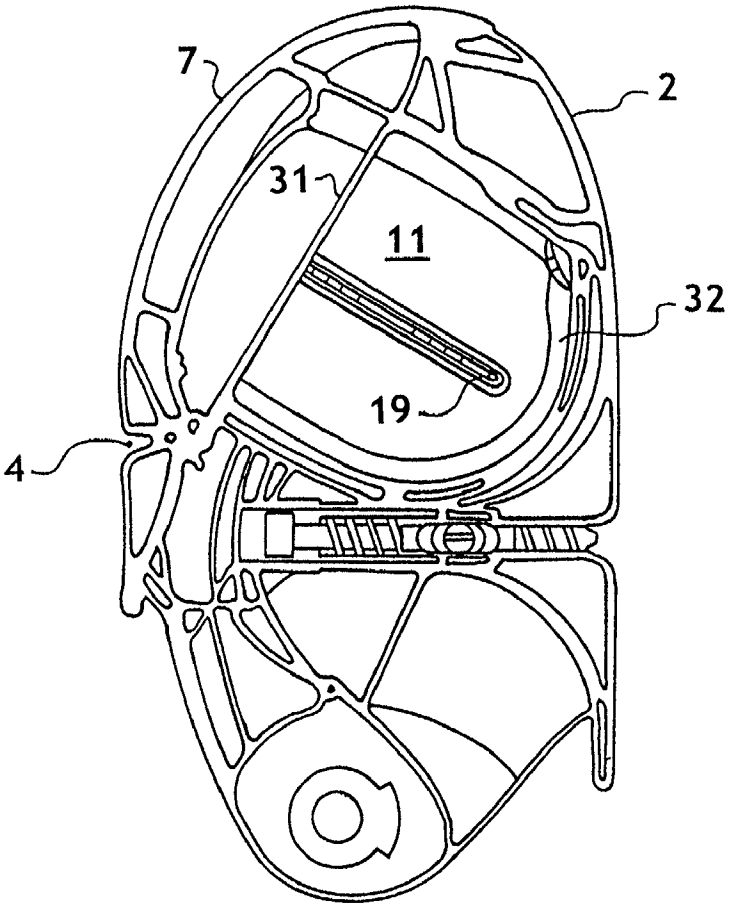

FIG. 5 is a cross-sectional view of the dispenser and cartridge of FIG. 2 taken along line A—A of FIG. 4A.

Figure 6:
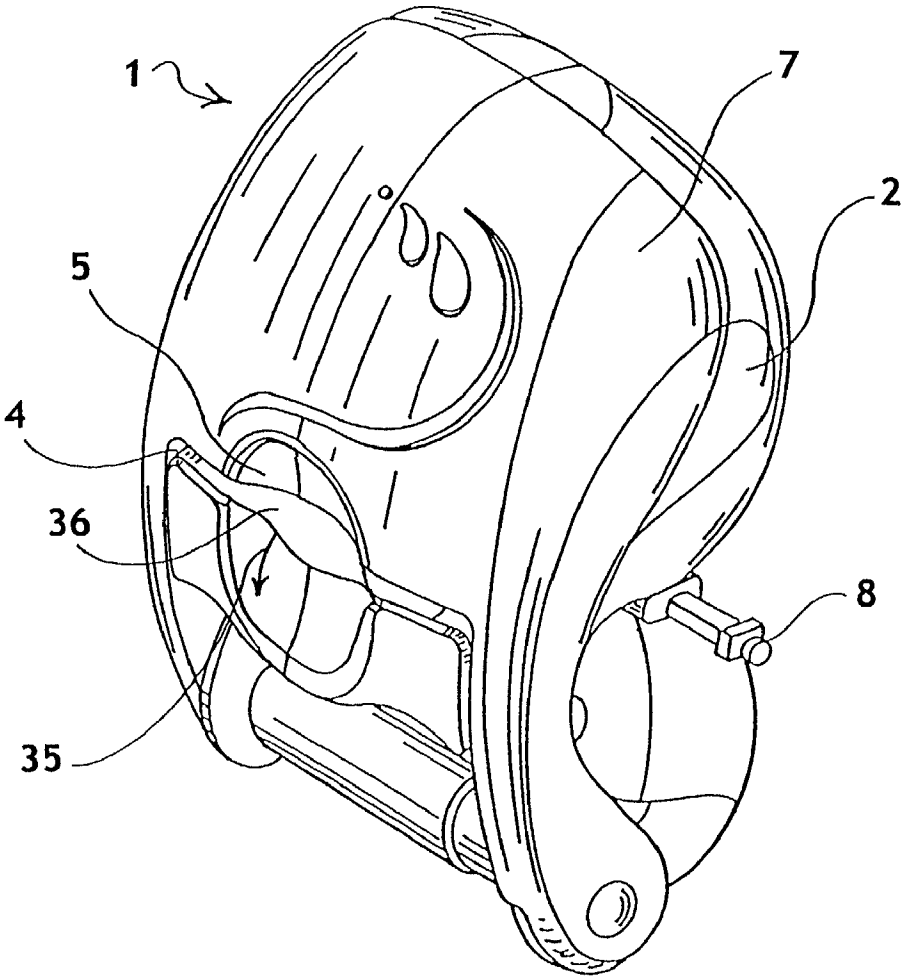

FIG. 6 is a perspective view of the dispenser of FIG. 1, with a wet wipe partial projecting out of the dispenser gap.

Figure 7:
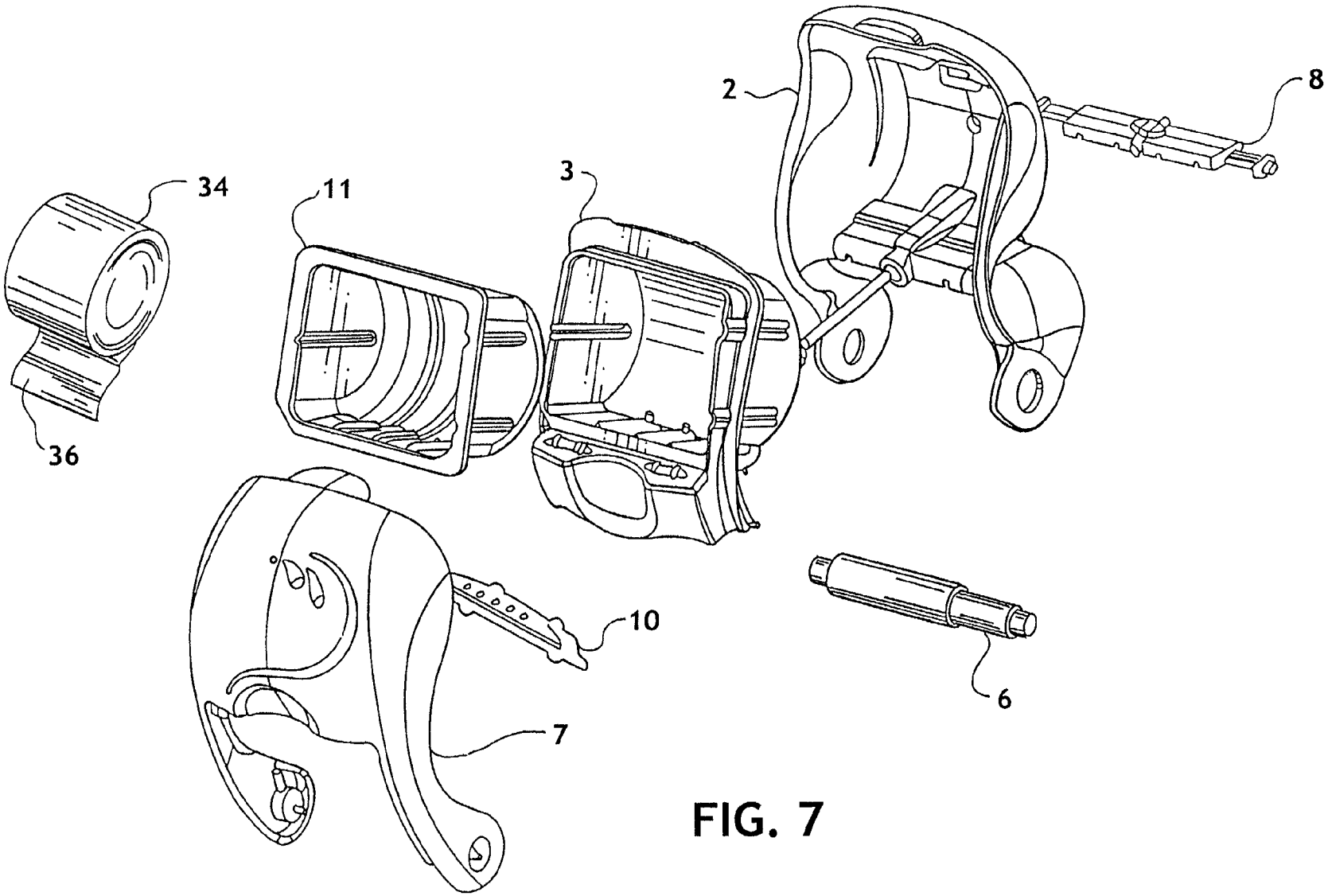

FIG. 7 is a perspective view of a dispenser, with a cartridge and a roll of wet wipes.

Figure 8:
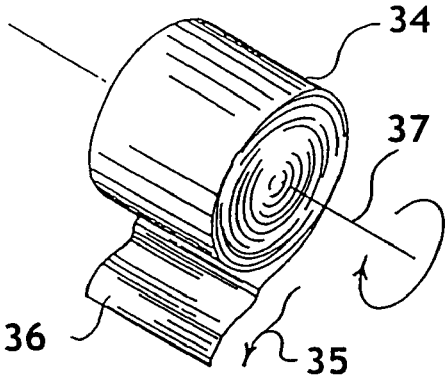

FIG. 8 is a perspective view of a roll of wet wipes

Figure 9:
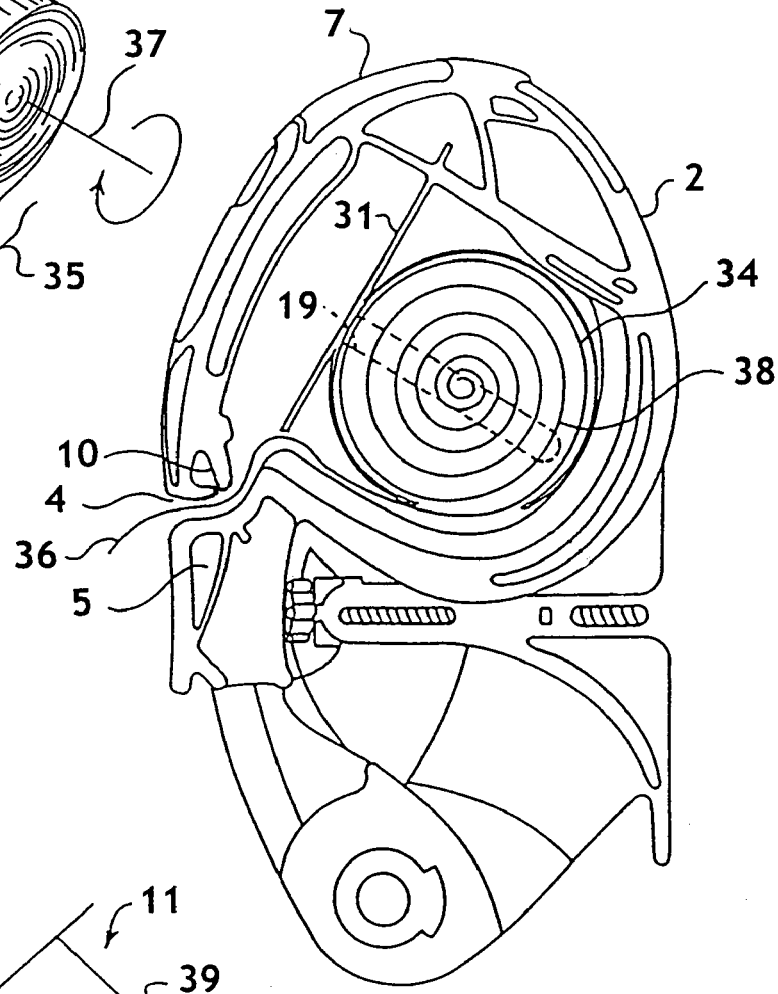

FIG. 9 is a cross-sectional view of the dispenser of FIG. 7, with the cartridge and roll of wet wipes position therein.

Figure 10:
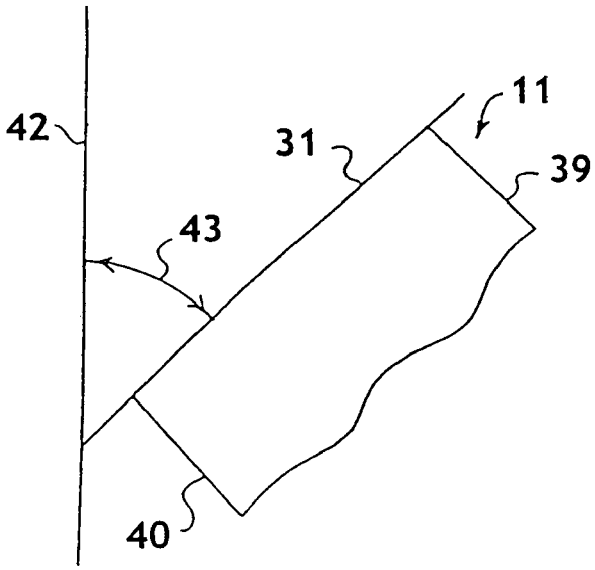

FIG. 10 is a cross-sectional view of a portion of a cartridge.

Figure 11:
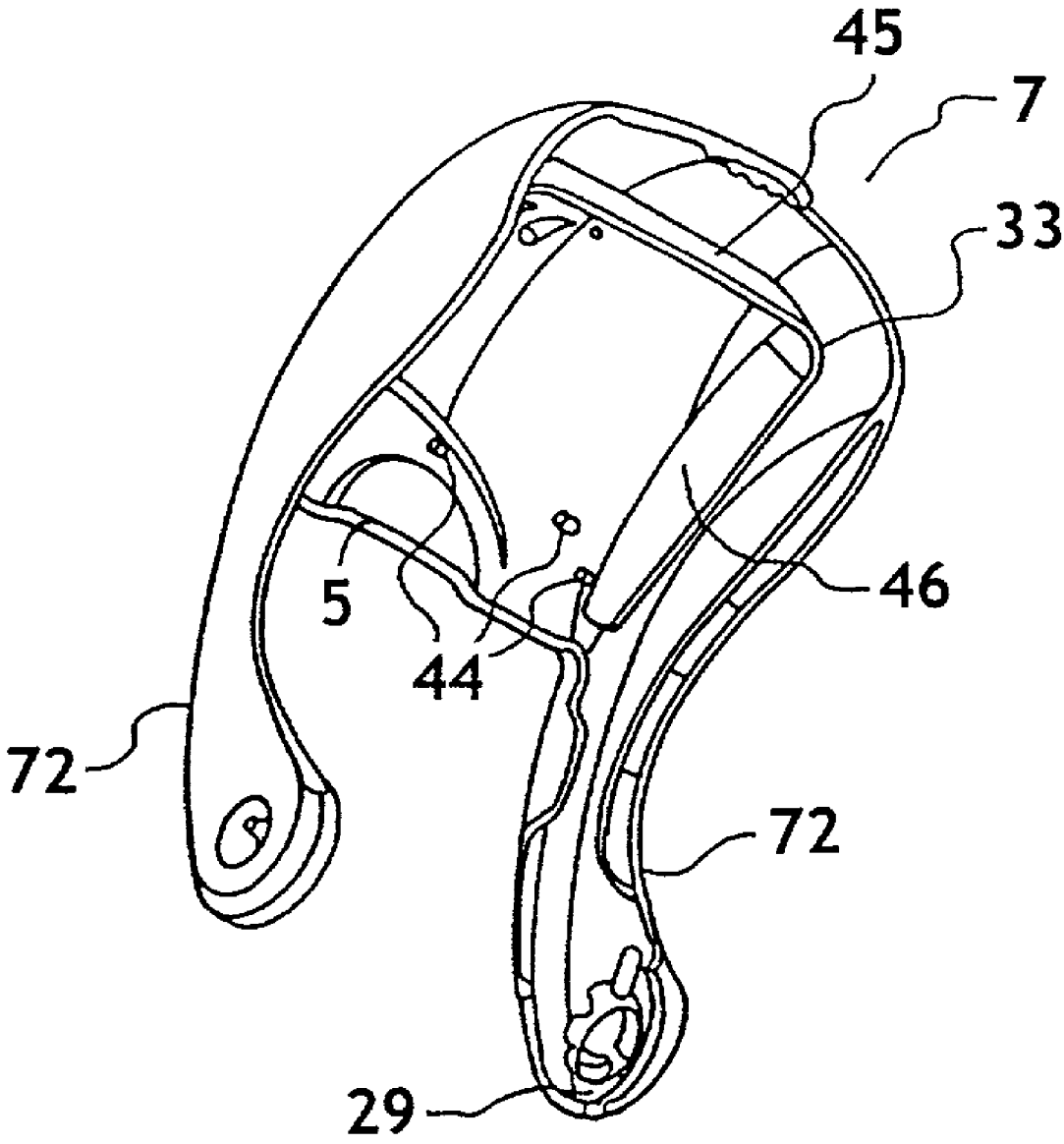

FIG. 11 is a perspective view of the inside of a cover for use with the dispenser.

FIGS. 12–16 are views of a wiper assembly.

Figure 12:
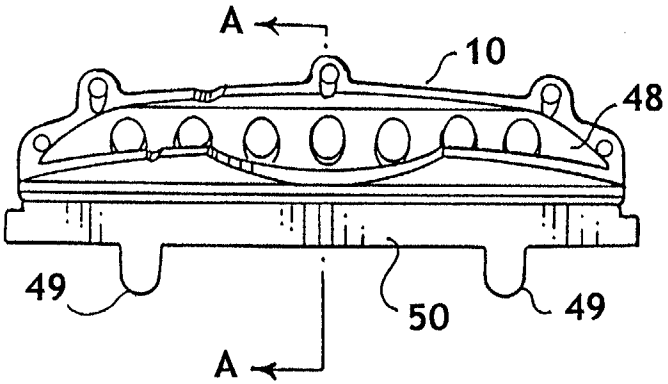
Figure 12A:
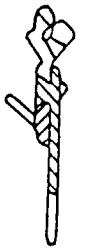

FIG. 12A is a view along line A—A of FIG. 12.

Figure 14:
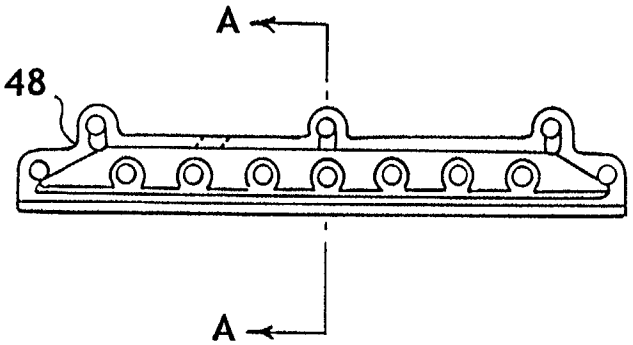
Figure 15:
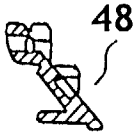

FIG. 15 is a view along line A—A of FIG. 14.

Figure 17:
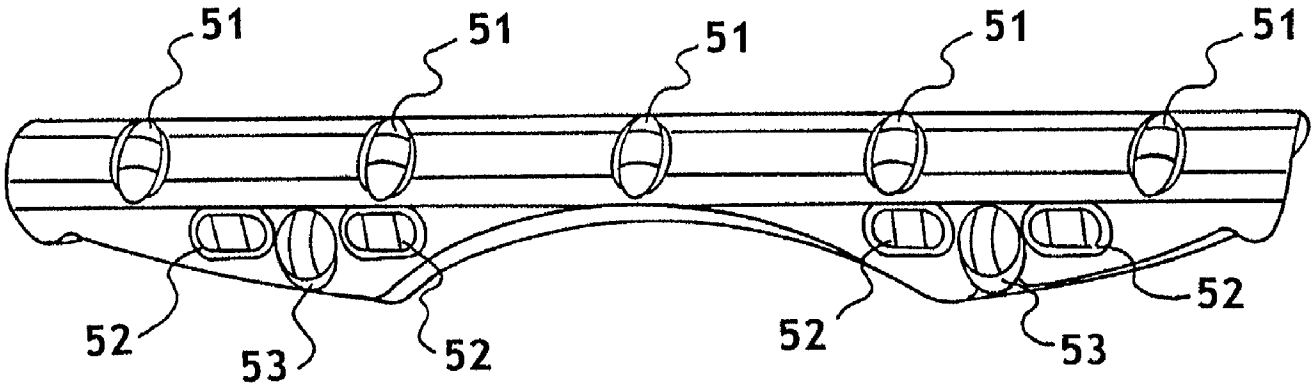
Figure 18:
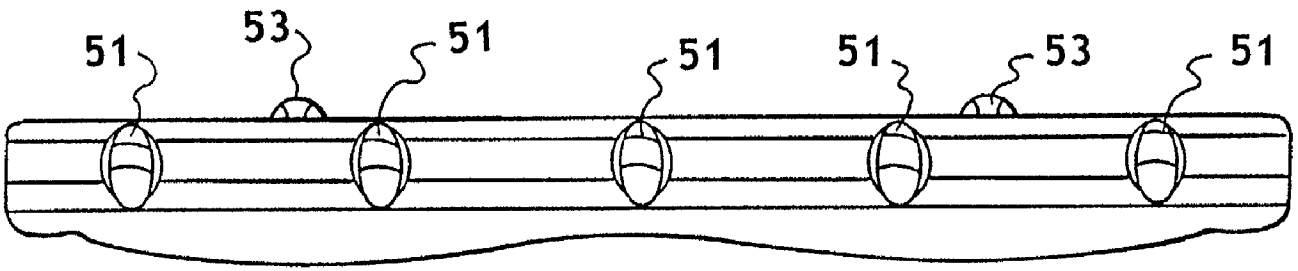

FIGS. 17–18 are views of a wiper.

Figure 19:
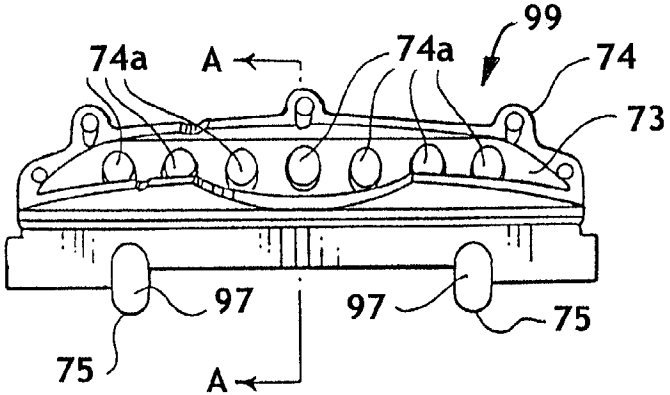

FIG. 19 is a back plan view of a wiper assembly.

Figure 20:
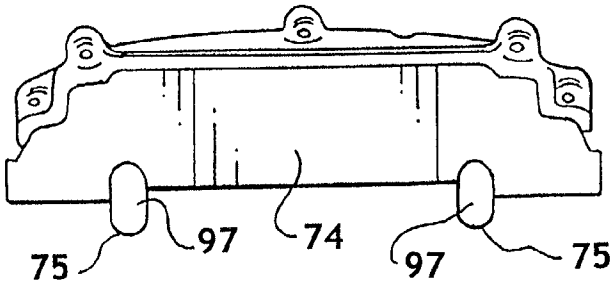

FIG. 20 is a front plan view of a wiper assembly.

Figure 21:
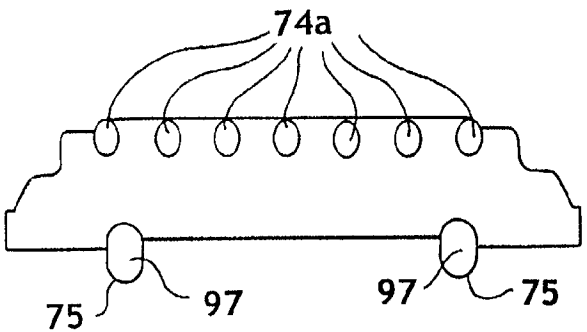

FIG. 21 is a back plan view of a wiper blade for use with the assembly of FIG. 20.

Figure 22:
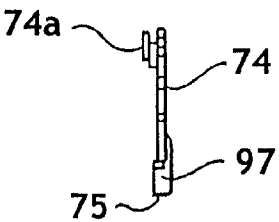

FIG. 22 is an end view of the wiper blade of FIG. 21.

Figure 23:
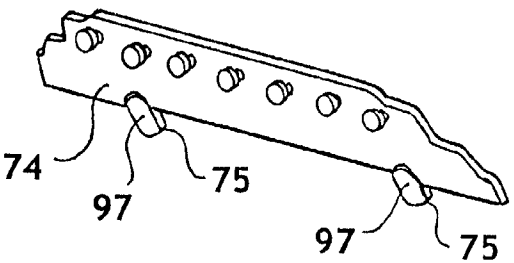

FIG. 23 is a back perspective view of the wiper blade of FIG. 21.

Figure 24:
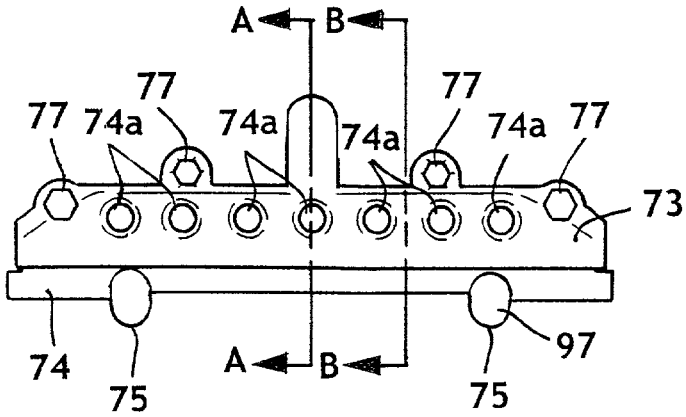

FIG. 24 is a back plan view of a wiper assembly.

Figure 25:
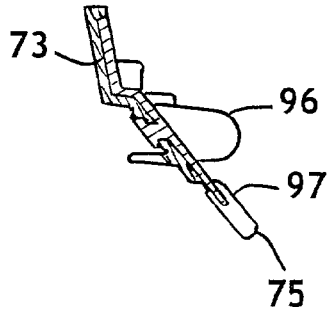

FIG. 25 is a cross-sectional view of the wiper assembly along line A—A of FIG. 24.

Figure 26:
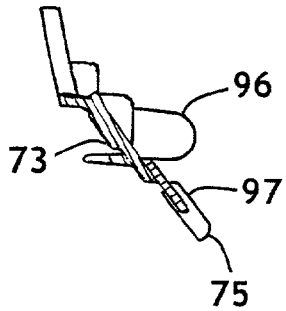

FIG. 26 is a cross-sectional view of the wiper assembly along line B—B of FIG. 24.

Figure 27:
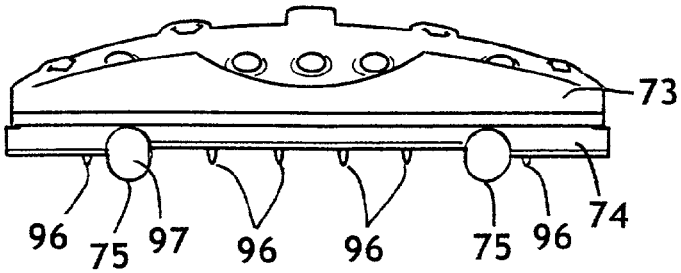

FIG. 27 is a back-bottom perspective view of the wiper assembly of FIG. 24.

Figure 28:
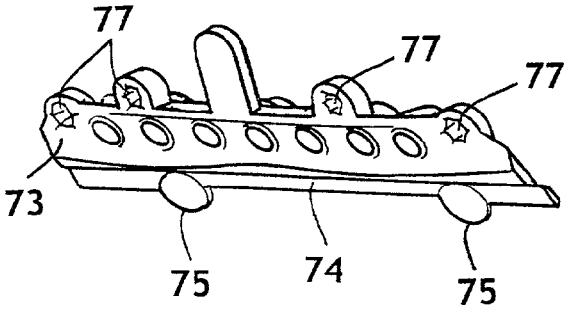

FIG. 28 is a back-top perspective of the wiper assembly of FIG. 24.

Figure 29:
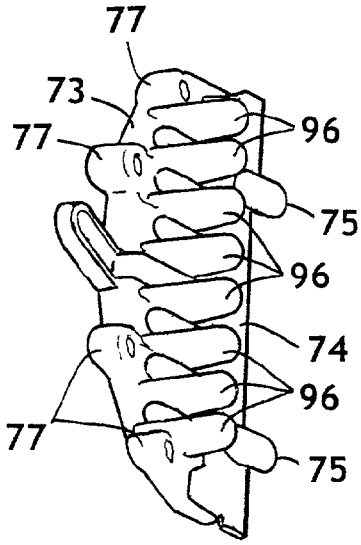

FIG. 29 is a front-top perspective of the wiper assembly of FIG. 24.

Figure 30:
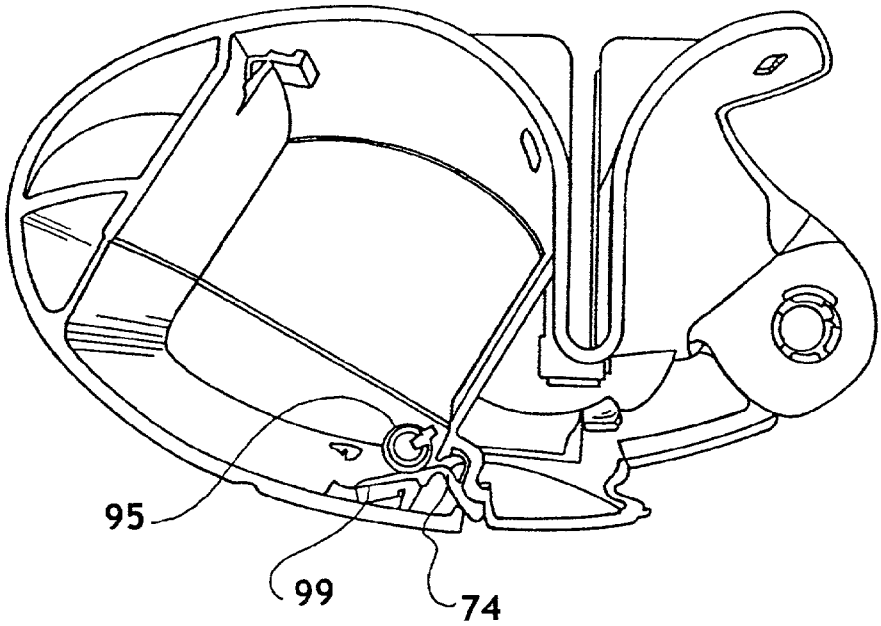

FIG. 30 is a cross-sectional view of a dispenser without a cartridge therein.

Figure 31:
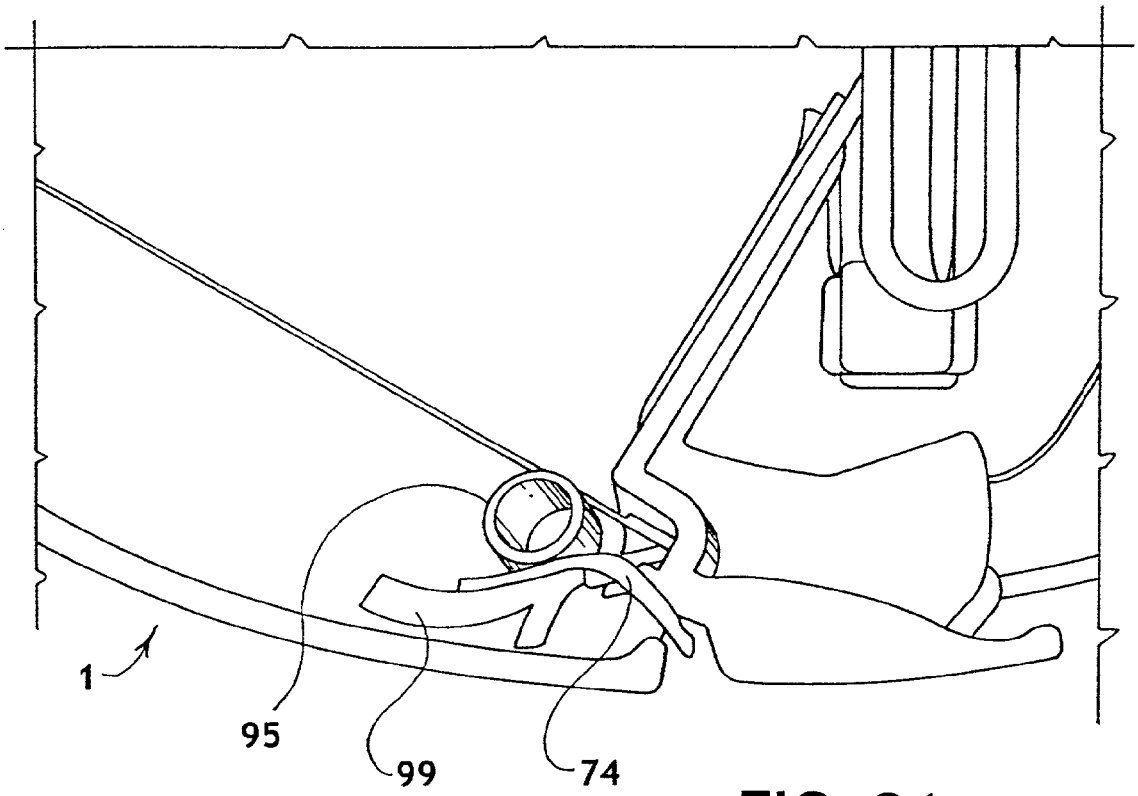

FIG. 31 is an exploded cross-sectional view of a portion of the dispenser of FIG. 30.

Figure 32:
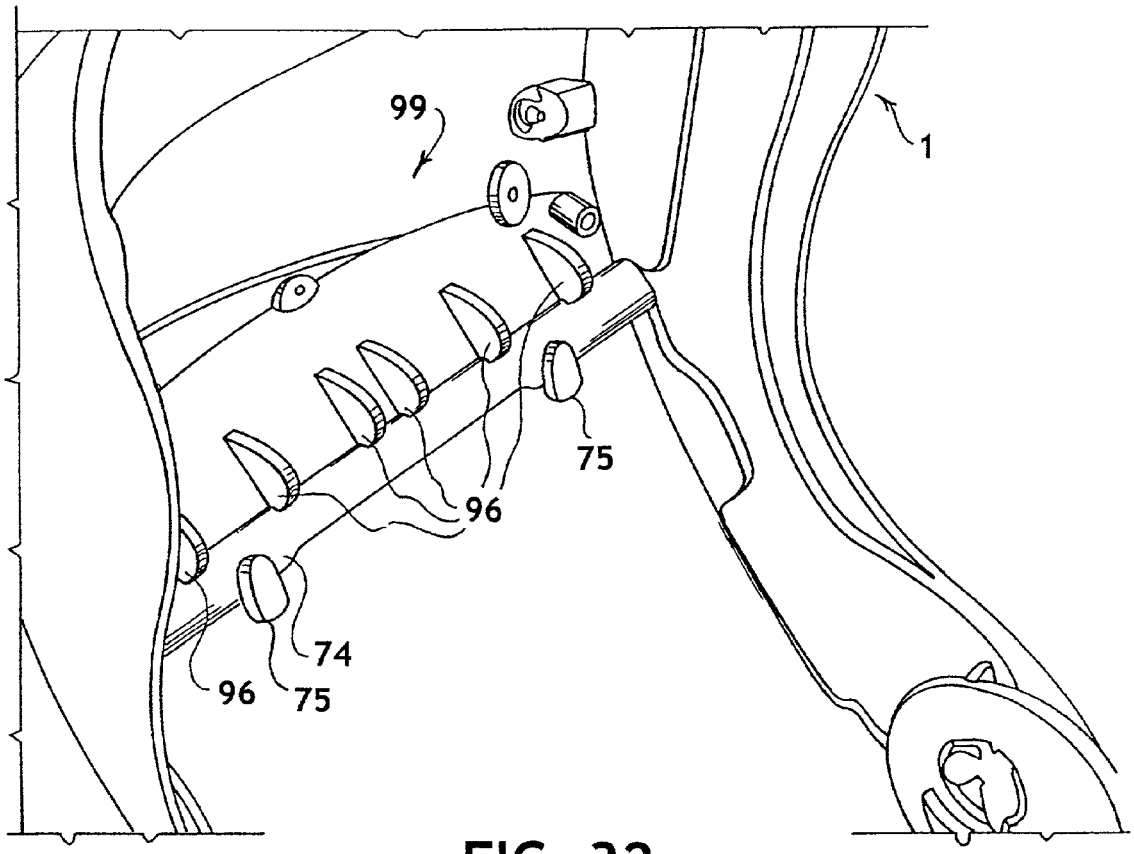

FIG. 32 is a perspective view of a portion of the inside of a cover for use with a dispenser.

Figure 33:
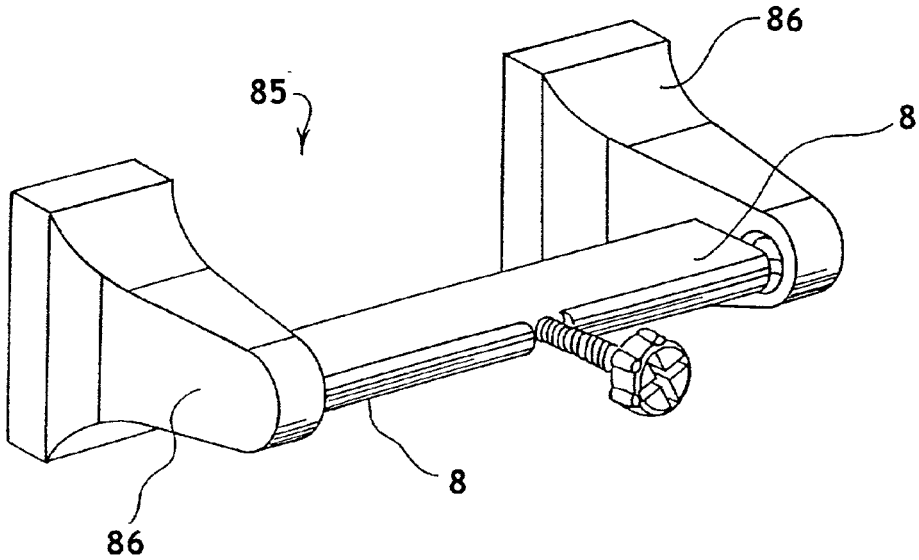

FIG. 33 is a perspective view of a mounting assembly in a conventional bath tissue holder (shown without a dispenser).

Figure 34:
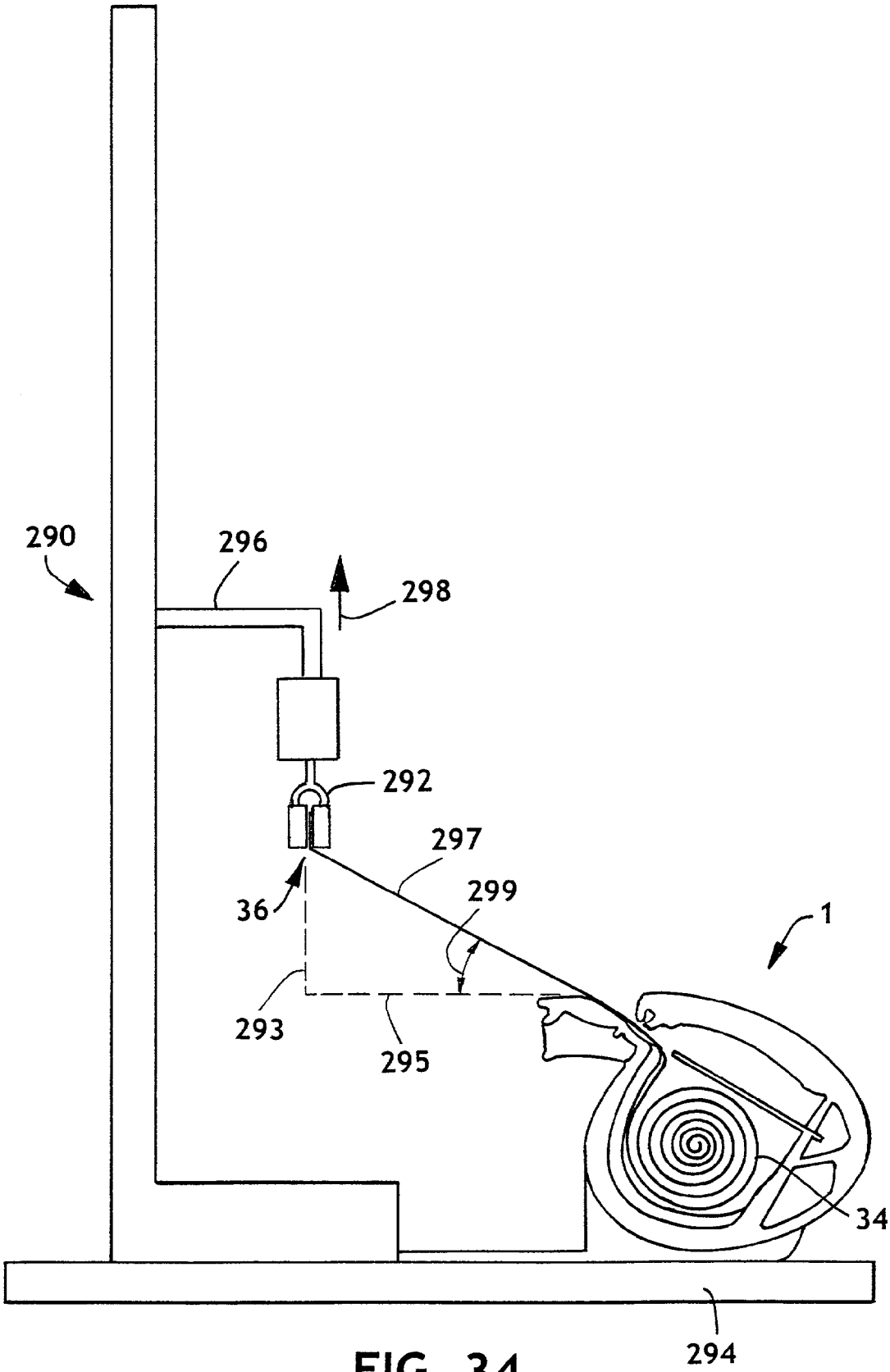

FIG. 34 is a schematic cross-sectional view of a dispenser and a test machine with wipes about to be dispensed in a test procedure.

Figure 35:
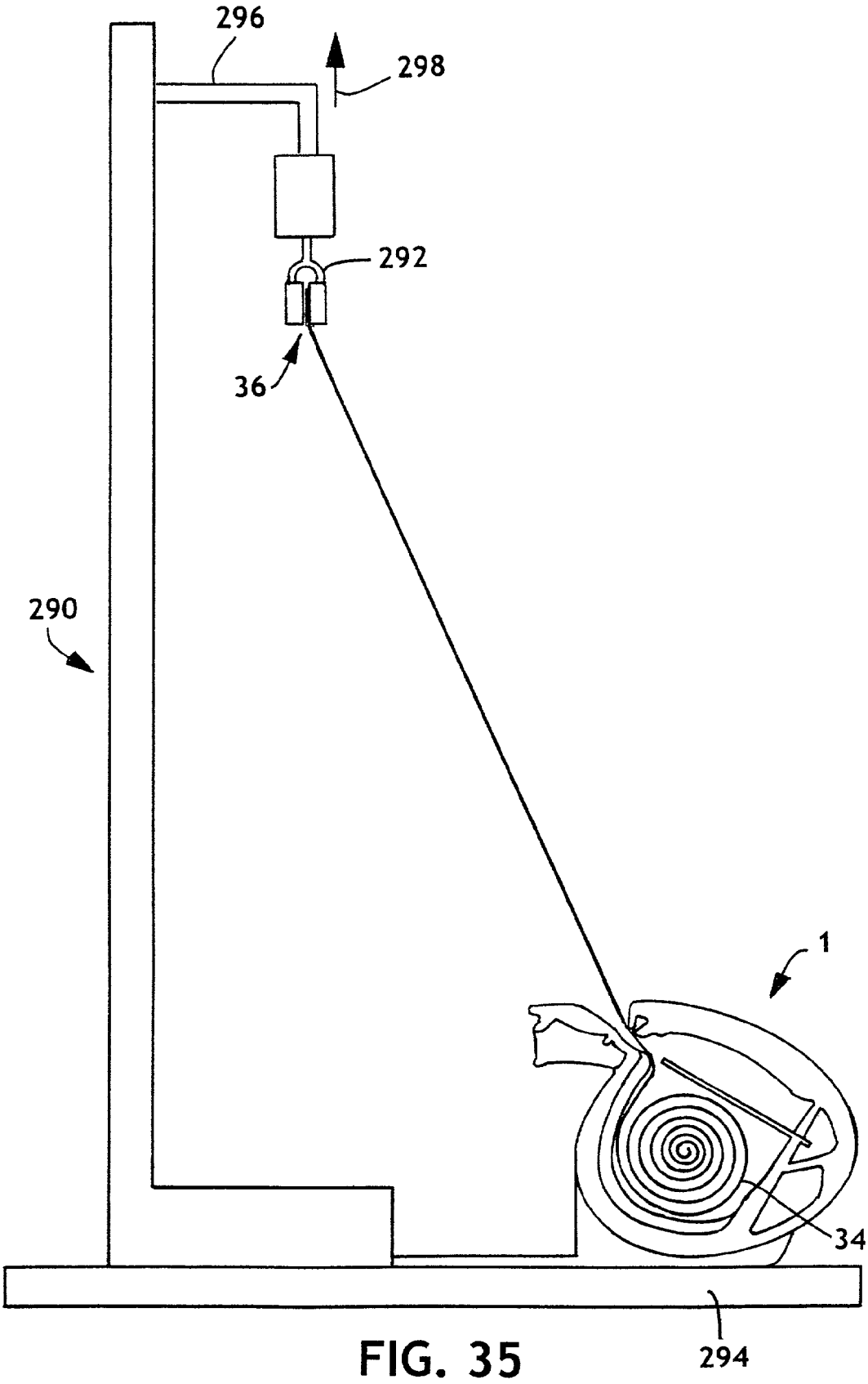

FIG. 35 is a schematic cross-sectional view of the dispenser, test machine and wipes of FIG. 34, but now with more wipes dispensed in the test machine's final position when a portion of the test procedure is complete.

Figure 36:
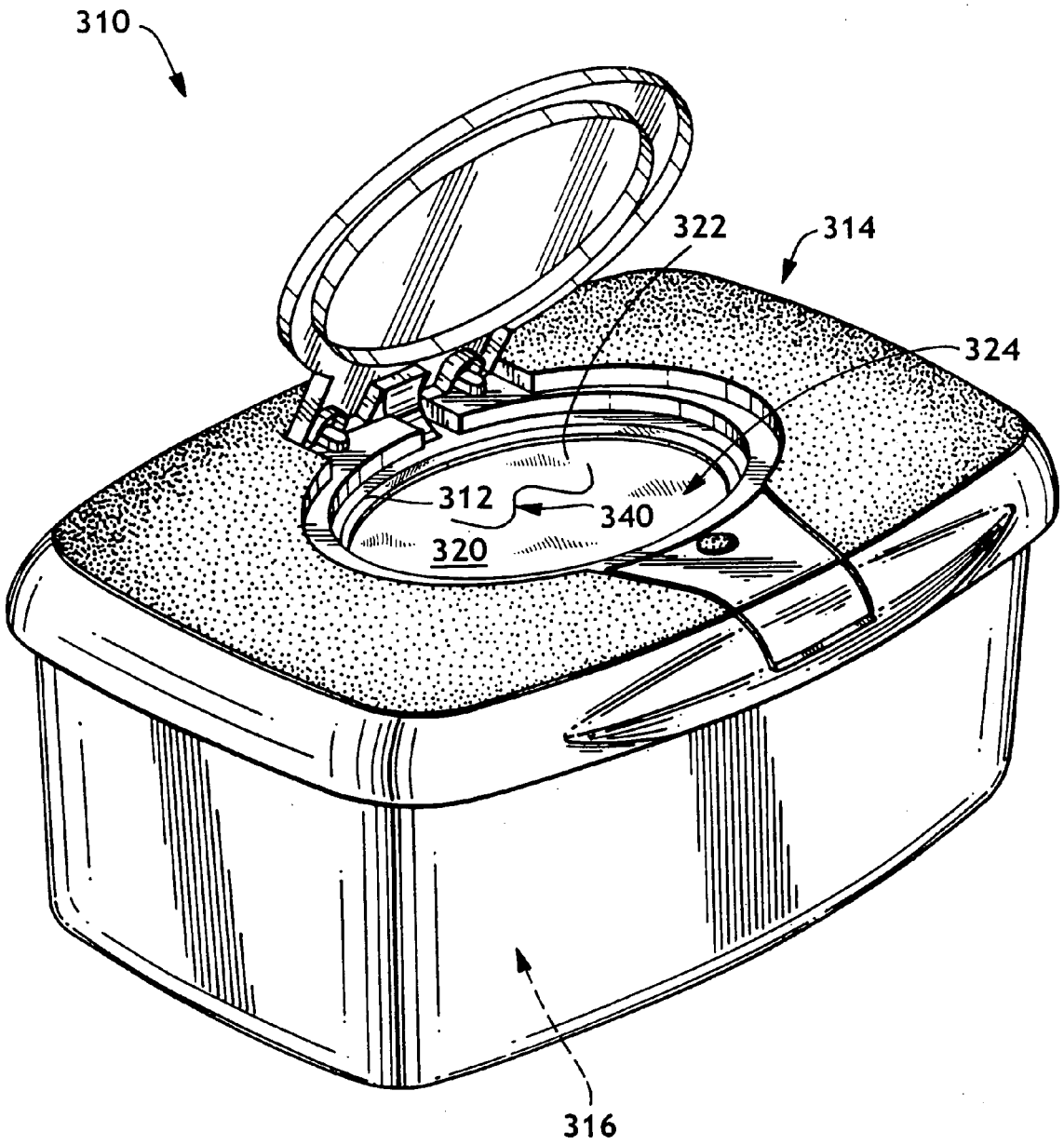

FIG. 36 representatively shows a flexible elastic sealing orifice for pop-up style dispensing with a wet wipes dispenser, in accordance with the present invention.

Figure 37:
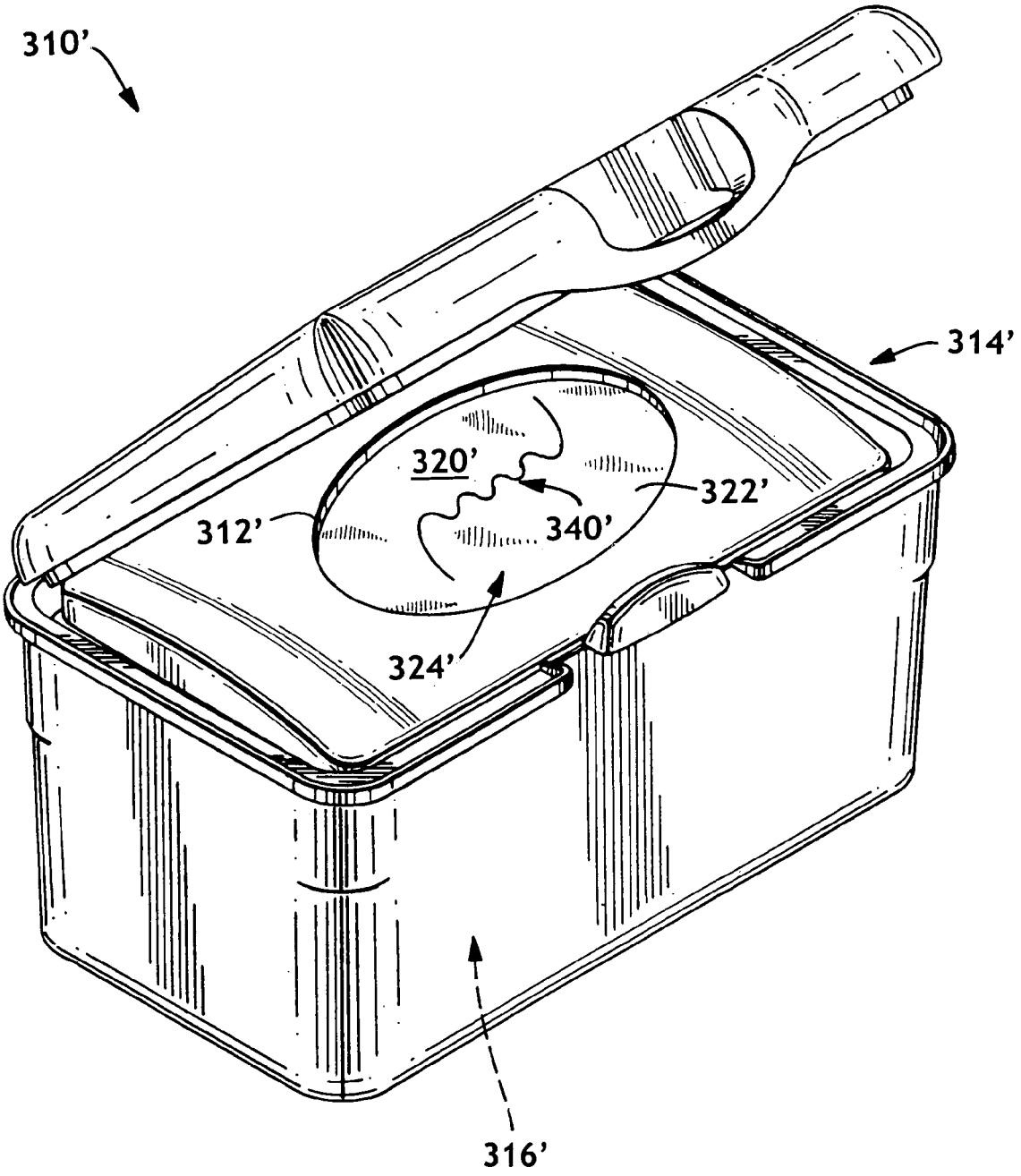

FIG. 37 representatively shows an alternate flexible elastic sealing orifice for pop-up style dispensing with an alternate wet wipes dispenser, in accordance with the present invention.

Figure 38:
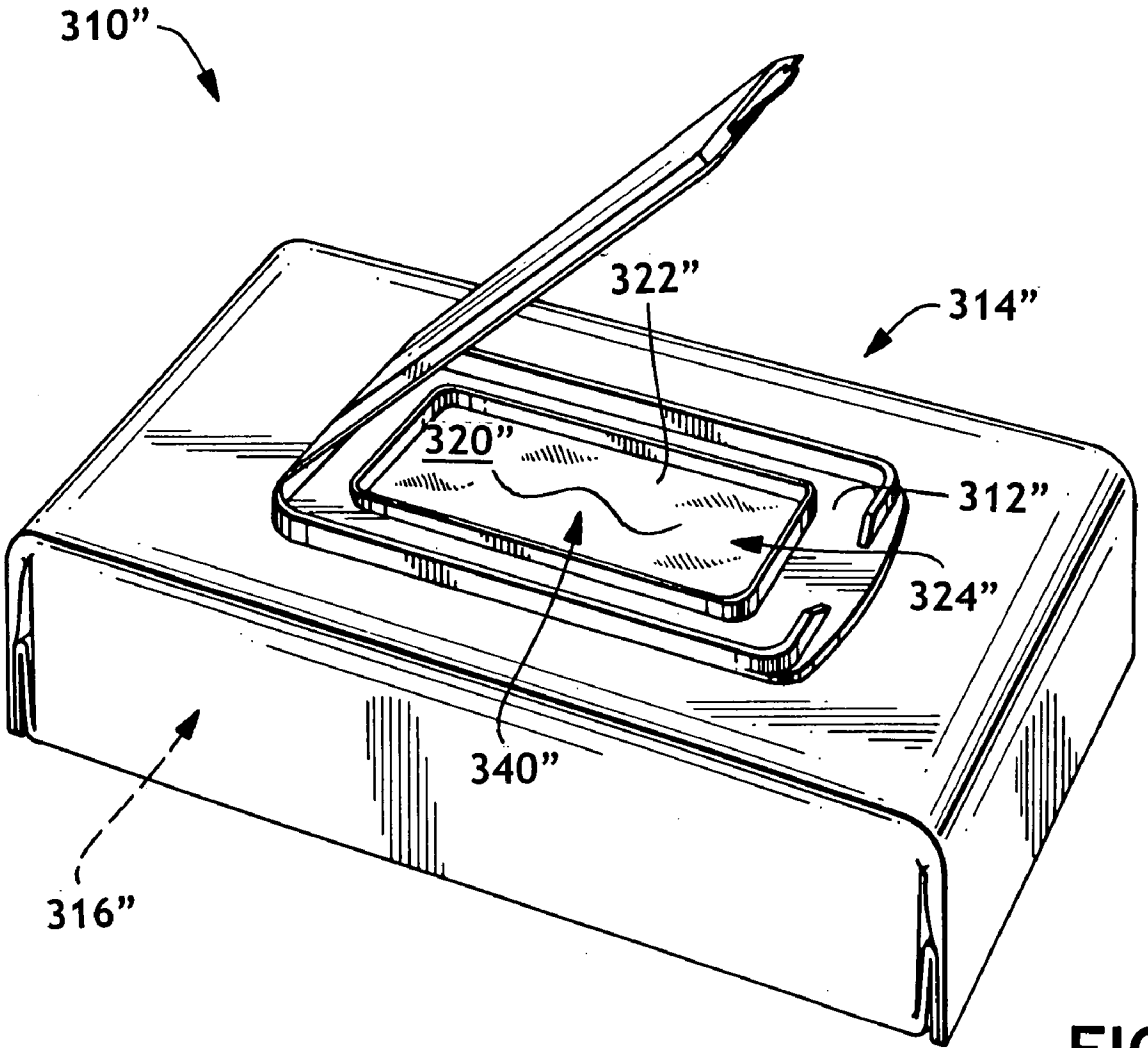

FIG. 38 representatively shows a flexible elastic sealing orifice like that of FIG. 36 but with an alternate wet wipes dispenser, in accordance with the present invention.

Figure 39:
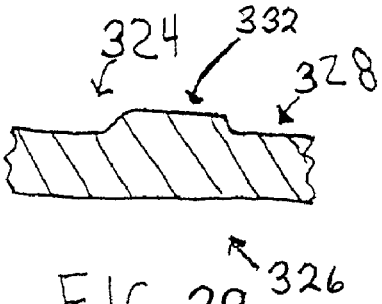

FIG. 39 representatively shows an enlarged view of the flexible elastic sealing orifice of FIG. 36 prior to cutting a continuous slit.

Figure 40:
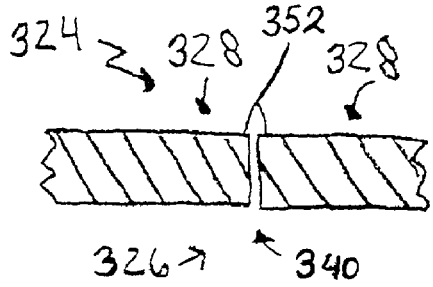

FIG. 40 representatively shows an enlarged cross sectional view of a sheet portion of the flexible elastic sealing orifice, taken along the line 5—5.

Figure 41:
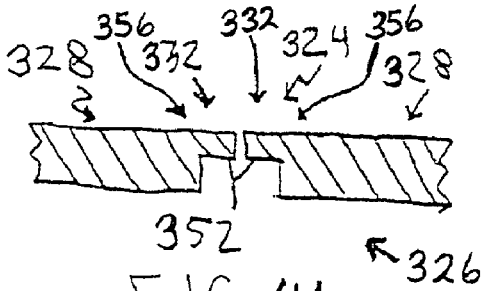

FIG. 41 representatively shows an enlarged cross sectional view of a sheet portion of the flexible elastic sealing orifice, taken along the line 6—6.

Figure 42:
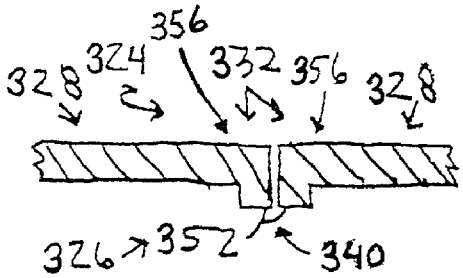

FIG. 42 representatively shows an enlarged cross sectional view of a sheet portion of the flexible elastic sealing orifice, taken along the line 7—7.

Figure 43:
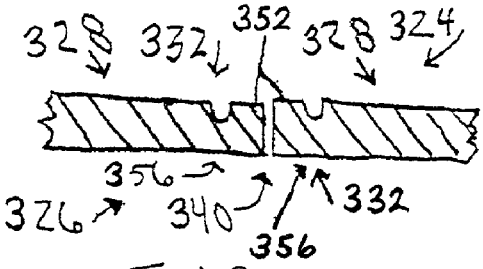

FIG. 43 representatively shows an enlarged cross sectional view of an alternate sheet portion of a flexible elastic sealing orifice, similar to the view in FIG. 42 taken along the line 7—7.

Figure 44:
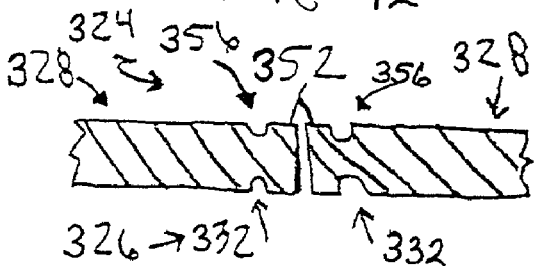

FIG. 44 representatively shows an enlarged cross sectional view of yet another alternate sheet portion of a flexible elastic sealing orifice, similar to the view in FIG. 42 taken along the line 7—7.

Figure 45:
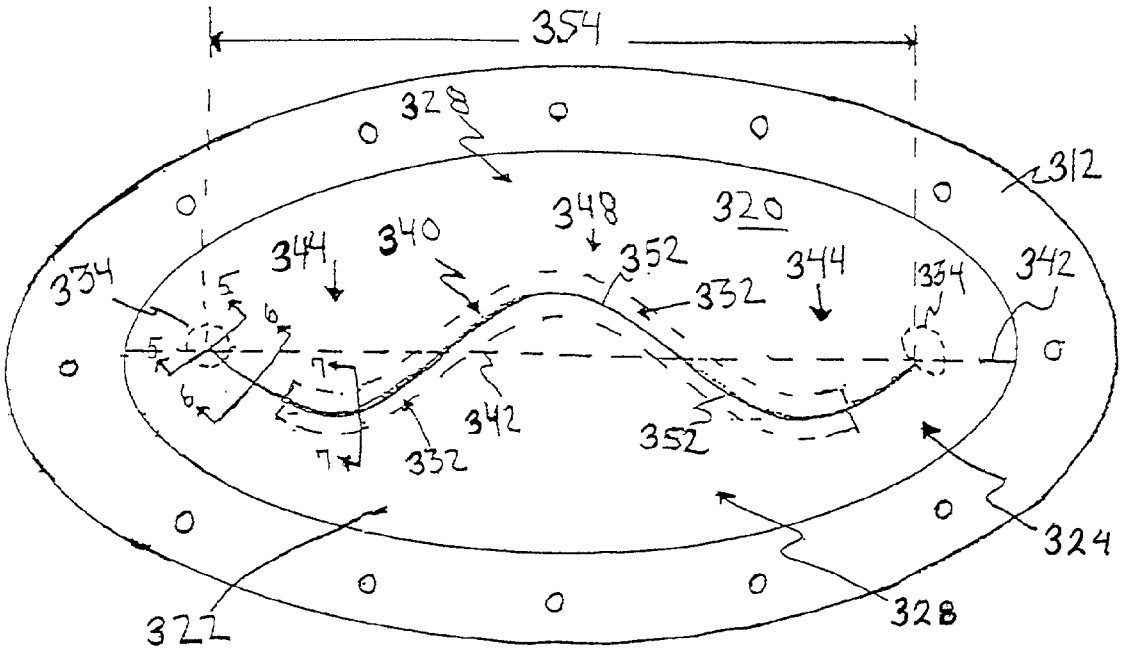

FIG. 45 representatively shows the flexible elastic sealing orifice of FIG. 36 surrounded by a rigid port.

DETAILED DESCRIPTION OF PRESENTLY PREFERRED EMBODIMENTS OF THE INVENTION

A system and method for dispensing and providing wipes is provided, which in general may have a housing, a cover, and a cartridge having a plurality of wet wipes. The plurality of wet wipes is placed in the housing and then the wipes can be removed from the dispenser.

In general there is provided a device for mounting a wet wipes dispenser to another surface. That surface may be, by way of example, a wall in a bathroom, a kitchen wall, or a bathroom vanity wall. The device may be used with, or adapted for use with, most any type of wet wipes dispenser, such as the various dispensers illustrated and disclosed herein. The device is ideally adapted to work in conjunction with a conventional bath tissue holder to permit a dispenser to be securely, yet removably attached to the wall. A conventional bath tissue holder is the type that is typically found in a home. Such holders have posts that protrude from the wall and a rod or roller that is positioned between the posts. These holders may also be partially recessed into the wall. Such a holder and a holder with a mounting assembly engaged are illustrated in FIG. 27. The device may also be used in the absence of a conventional bath tissue holder and may be adapted to provide that the dispenser is fixed to the wall.

For example, the system may have a dispenser that has a housing, which is capable of being mounted to a surface, such as a wall, a cabinet, an existing bath tissue dispenser, a toilet, a toilet tank, a stall wall, or a dashboard of an automobile. The dispenser has an opening that holds a cartridge, which contains the wet wipes. These cartridges are sealed. The user may then open a cartridge, put it in the dispenser, and use the wipes as needed. When the wipes are used up, the user may simply discard the old cartridge and replace it with a new one, or reuse the old cartridge and simply provide a new roll of wet wipes.

The present invention is directed at enhancing wet wipes and containers for wipes, e.g., rolls or stacks of wet wipes and dispensing of the same. As representatively illustrated throughout the figures, and for explanation now referring to FIGS. 1 through 5, inclusive, there is provided a dispenser 1, which has a housing 2, a tray 3, a cover 7, and a mounting assembly 8. The tray and the cover form a gap 4, through which a wet wipe can extend. That portion of the wipe extending through the gap may be referred to as a tail. The tray and cover additionally have recesses 5, that form an indentation that provides a finger hold, or point where a user can grasp the wet wipe to pull it from the dispenser. Although optional, this dispenser is also provided with a roller 6 for mounting and dispensing a roll of another product, such as dry or conventional bath tissue.

In general the dispenser system illustrated herein can be used with or without conventional dry toilet or bath tissue. If conventional tissue is used with wet wipes it could be positioned in a side-by-side manner, above, or below the wet wipes.

FIGS. 1 and 4–4B, inclusive, show the dispenser with the cover closed. In FIGS. 4 and 4B, it can be seen most easily that the dispenser generally has a top 100, a side 101, a side 102, a back 103, a bottom 104 and a front 105. FIG. 2 shows the dispenser and a cartridge in an exploded view. FIG. 3 shows the dispenser assembled and in a fully opened condition.

The housing may be made from any suitable material, such as plastic, wood, ceramic, porcelain, glass, paper, metal, thermoplastic elastomers, or composite materials. For example, polypropylene, polyesters such as polybutylene terephthalate (Pbt), Pbt glass filled, Pbt 15% glass filled, fiberglass, carbon fiber, and acrylonitrile-butadiene-styrene (ABS) may be used to make the housing.

The housing may have different shapes and sizes. When the dispenser is intended for use in a home it is desirable that it be of a size that is similar to conventional bath tissue roller mounts. It is particularly desirable that the dispenser be as compact as possible for home use. Further if the cover is in the range of from about 4½ inches (114.3 mm) to 6⅞ inches (174.6 mm) in width it will be able to aesthetically fit in or mount to the vast majority of toilet paper holders that are in existing houses. Advantageously the width of the cover may be greater than about 3 inches (76.2 mm), less than about 6 inches (152.4 mm), less than about 7 inches (177.8 mm), and less than about 8 inches (203.2 mm). The 4½ inches (114.3 mm) by 6⅞ inches (174.6 mm) size provides an added benefit of enabling one size of dispenser to be used in the vast majority of applications in the home. Smaller sizes may be desirable for certain applications or aesthetic reasons, such as a small bathroom. The dispenser and its components may have varied colors, such as the almonds and whites that are seen in porcelain bath fixtures or may have any other desirable color. When the housing is used for industrial or institutional purposes or in commercial applications it may be desirable to make the housing substantially larger and able to hold substantially more rolls of either or both wet and dry wipes and tissue.

The housing may be configured as shown in FIG. 1 to mount onto or into a conventional wall mount toilet paper holder. It may also be mounted directly to a wall, for example by way of a screw, through mounting hole 30, or by other means of fixing the housing to a wall or surface, such as glue, nails, screws, rivets, magnetic attachments, staples, engaging brackets and pressure mountings against the sides of a conventional wall mount for toilet tissues. The housing also may have a lock 13 that engages a tab 12 on the cover to keep the cover closed, yet provide an easy way to open the dispenser. Various other ways to lock or fix the cover to the housing may also be employed. For example, a lock and key approach may be desirable in commercial applications or houses where there are small children present.

The housing may also have an opening 14 that is made to receive cover mounts 29. The opening 14 and the cover mounts 29 may further be configured to receive a conventional toilet tissue roller. The housing may further be configured to support a means of dispensing, storing, containing or mounting another product such as wipes, toilet tissue, or the like. For example, the housing may support a shelf which may in turn support a container of wet wipes having the same or a different composition from that of the wipes inside the housing. The housing may further have an opening 28 for receiving a pin 27 on the tray 3.

The cover 7 may be made of any similar material to the housing; it may be the same as or a different material from the housing. The cover may be clear or have a window for viewing the amount of wet wipes that remain in the dispenser. It is noted, however, that because the cover is in direct contact with the wet wipe, the cover forms the top of the cartridge when the cartridge is inserted into the dispenser and the cover closed, and wood or any other material that would support bacterial growth would not be favored. It can be advantageous that all materials that are in contact with the wet wipes be made from materials that discourage, or do not support bacterial growth.

Moreover, anti-bacterial agents, medicinal, botanical or skin and health agents may be added to the materials that are used to construct the components of the dispenser system, including by way of example the dispenser housing, the tray, the wiper blade, the wiper assembly, the cartridge, the cover and the gaskets. In particular any component that is in contact or associated with the wet wipes may have such an agent added to it.

The cover is designed to cooperate with the cartridge 11 to form a barrier to moisture loss from the wet wipes. The cover may also be designed to cooperate with other components of the dispenser system to form a moisture barrier. The dispenser can maintain wet wipes in a moist condition when fully closed for at least 1 day, for at least 2 days, for at least 5 days and for at least 14 days, and advantageously for more than 14 days at room conditions of 73° F. (22.8° C.) and 50% relative humidity. The dispenser when fully closed can maintain at least about 15%, at least about 20%, at least about 25%, at least about 50%, at least about 65%, and at least about 95% of the moisture of the wipes for a 14 day period at 73° F. (22.8° C.) and 50% relative humidity. These moisture retention values can be obtained with a tail of the wipe protruding through the gap, the tail having a length of not more than 1.5 inches (38.1 mm).

The cover may further be designed to cooperate with the cartridge 11, or other components of the dispenser system, to form a barrier to contamination of the wipes within the dispenser. Thus, the cover in cooperation with the cartridge, or other components of the dispenser system, may form a barrier to dirt, dust, mold spores and bacteria.

The space between the inner surface of the front cover and the surface of the lip of the cartridge may vary between about 2 mm and about 10 mm. In this way there is formed a dome above an open cartridge that at least partially covers that opening, which dome is advantageously less than about 15 mm, less than about 10 mm, less than about 5 mm and ideally is less than about 2 mm above the lip of the cartridge. The height of the dome may also be measured from the surface of a full roll of wet wipes in which an additional 2 to 7 mm may be added to the height of the dome. Higher domes may also be employed, but such higher domes may be less aesthetically pleasing and may provide for greater amounts of evaporation or moisture loss from the wet wipes.

The cover may be provided with an inside rim 33 (see, e.g., FIG. 3) and a wiper or wiper assembly 10 (see, e.g., FIGS. 2 and 3). The cover inside rim and wiper cooperate with the lip 31 of the cartridge. In this way when the cover is closed the inside rim is brought against the lip of the cartridge and the wiper is similarly brought against the tray including the guides, as well as the lip of the cartridge. In a further embodiment, the cover may be provided with a lip, and the cartridge may be provided with a rim to facilitate the cooperation.

FIG. 11 shows an example of a cover. In this example the cover 7 has cover mounts 29, a recess 5 for forming part of a finger hold indentation, an inside rim 33, which has a top inside rim section 45 and side inside rim sections 46 (of which only one can be seen in FIG. 11), leg sections 72, and posts 44. In this example the posts are used to connect the wiper 10 (not shown here) to the cover by mounting holes 77 (FIGS. 24–29, e.g.). Other embodiments of the rim 33, also known as a gasket, are disclosed in pending U.S. application entitled "DISPENSER GASKET AND TENSIONER SYSTEM", Ser. No. 09/849,935, filed May 4, 2001, the disclosure of which is hereby incorporated by reference. As discussed herein, Ser. No. 09/849,935 also discloses embodiments for the wiper, wiper assembly and wiper blade that can be used with the present invention.

The distance between the inside of the cover where the wiper 10 is located and the tray may be less than the height of the wiper blade. Thus, in this configuration the wiper blade would be placed under compression against the lip, the tray, or the guides 16 or all of them depending on the position of the wiper. Here the wiper blade would exert pressure on at least a portion of the wet wipes. The wiper blade may also be positioned so that it contacts the wet wipe but does not exert pressure against it, or be positioned so that it is a short distance above the wet wipe. The amount of pressure that the wiper blade exerts on the wet wipe may vary depending upon several factors, including the purpose for the wiper, the material that the wiper blade is made from, the material that the wet wipe is made from and the material that the cartridge lip 31 is made from. Additionally, the wiper or wiper assembly and the wiper blade can be distinct parts, can be integrally joined together from distinct parts or can be integrally formed as one part with one or more of the wiper features.

The tray 3 may be made from any similar material to the housing or cover, and it may be the same material or different material from those of components. The tray may have side walls 22, 23, 80 and 81. Walls 22 and 23 correspond to the sides of the dispenser, wall 80 corresponds to the top of the dispenser, and wall 81 corresponds to the bottom of the dispenser. The embodiment of the tray 3' shown in FIG. 3 does not have a back wall, although one may be provided if desired as shown in FIG. 2 and FIG. 7. The side walls may be provided with recesses 24, 25, and 26. These recesses cooperate with protrusions 19, 20 and 21 on the cartridge (19 with 26, 20 with 24 and 21 with 25). In this way the cartridge is securely, yet easily removably held in the dispenser. The tray opening 15 is sized in relation to the cartridge (or the cartridge may be sized in relation to the tray opening) so that the cartridge can easily be slid into and out of the dispenser.

In a further example of the tray, the tray is fixed to the housing. This may be accomplished by having the housing and tray being made out of a single piece of material or having the housing and tray joined together by a permanent bonding means, such as welding, heat bonding or gluing. In yet a further example the tray may be attached to the housing so that is cannot rotate with respect to the housing, yet still may be removable.

Referring to FIGS. 2 and 2A, e.g., the housing may further have guides 16. The guides may be movable or fixed. The guides may have raised surfaces 16*a* and lowered surfaces 16*b*. These guides may be made from the same type of material as the housing. They may be integral with the housing. The guides and the housing may be one continuous piece of plastic. The guides may be designed to cooperate with the wiper to prevent or reduce the tendency of the wipe to skate to one side of the dispenser as the wipe is pulled out and torn off. The guides may also cooperate with the wiper to regulate and control the amount of drag between the wet wipe and the dispenser.

The cartridge may be made out of any suitable material, such as plastic. The cartridge can be made from a light weight, inexpensive, disposable and recyclable material. The cartridge has side walls 17,18, 39 and 40 and bottom wall 41. The cartridge has a lip 31 that forms an opening at the top of the cartridge. The cartridge may be any shape or size provided that it fits in or cooperates with the dispenser. For example a cartridge that would be useful for application in the home would have side walls 17 and 18 that are less than 105 mm and side wall 39 and 40 that are less than 134 mm. Instead of protrusions 19, 20 and 21, the cartridge may have recesses at those locations, and the tray may have corresponding protrusions.

The container for the wet wipes may also be flexible. A flexible package made of plastic, metal foil, paperboard or combinations thereof may be used to seal the wipes in a wrapper or may be configured as a pouch with a removable cover. Any material and configuration that prevents the loss of moisture from the wet wipes may be used to package the wipes. A removable cover may contain a removable strip to facilitate dispensing of the wipes. The cover may also contain a lip to cooperate with the cover inside rim and the wiper. The combination of the wipes and the container may be the same size as or smaller than the cartridge so as to fit within the tray.

FIG. 6 shows a dispenser in the closed condition with a tail of a wet wipe 36 protruding from gap 4 into the finger hold indentation that is formed by recess 5. In use the tail of the wet wipe would be grasped and pulled generally in the direction of arrow 35 causing the roll to unwind and the wipe to be dispensed from the dispenser. In use the wet wipe may also be subjected to forces tangential and perpendicular to the direction of arrow 35. If these forces occur the guides and the wiper help to prevent the wipe from skating to one side of the gap and bunching up or binding.

FIG. 7 is an exploded view of a dispenser, cartridge and roll of wipes 34 showing the relationship of these components.

FIGS. 8 and 9 shows a roil of wipes 34 that has a tail 36 of the wipes extending through the gap 4, and further defines the axis of the roll as 37. Stacks or rolls useful with this dispenser or as part of a dispensing system may contain from as little as a few linear inches (or cm) to more than 450 linear inches (11.43 in), to more than linear 600 inches (15.24 m) to more than a thousand linear inches (25.40 m) of wet wipes. The stacks or rolls may have a web of material that may have any number of sheets. Usually, the sheets are separated by perforations that enable the sheet to be easily torn from the web but are strong enough that they will not separate while the web is being pulled from the dispenser. An example of a roll that is particularly useful for applications in the home is one that has a diameter of about 2 inches (50.8 mm) to about 3 inches (76.2 mm), of about less than 5 ½ inches (139.7 mm), and advantageously has a diameter of about 3 inches (76.2 mm) and more advantageously of about 2⅞ inches (73.0 mm). This roll has from about 400 linear inches (10.16 m) of wipes to about 1000 linear inches (25.40 m) of wipes. Without limitation, each sheet length may be from about 3 inches (76.2 mm) to about 10 inches (254.0 mm) and advantageously are about 4.5 inches (114.3 mm). This roll may further have a density of from about 0.3 g/cc to about 1 g/cc, from about 0.5 g/cc to about 1 g/cc and advantageously about 0.62 g/cc. A particular example of a roll may be one having a diameter of about 2 inches (50.8 mm) and containing about 450 linear inches (11.43 m) of wipe. Another particular example of a roll may be one having a diameter of about 3 inches (76.2 mm) and containing 450 linear inches (11.43 m) of wipes.

The form of wet wipes for use with the dispenser system can be a solid coreless roll as shown in FIG. 8. It is to be understood, however, that cored rolls (hollow cores, solid cores and partially solid cores), hollow coreless rolls, and stacks of sheets can also be used in the dispenser system. When density values are referred to herein, it is for the density of the roll and this would exclude any void, for a coreless hollow roll, or space occupied by a core for a cored roll.

Various tests and observations of physical properties are reported in Tables I, II, III, IV, V, VI and VII.

Solution add-on level is the amount of solution by weight divided by the amount of dry wipe by weight multiplied by 100 to provide a percentage value.

Base sheet converting refers to the width of the roll and the sheets in the roll, i.e., along axis 37 of the roll in inches.

Perforation refers to the amount of cutting and the distance between the cuts in the perforation that separates the sheets in a roll. There are three parameters to this measurement: cut length, bond length and bond spacing. The bond spacing is equal to the sum of the cut length plus the bond length. By way of example, perforations that are useful with wet wipes are ones that have a bond length of 0.02 inch (0.51 mm), a cut length of 0.05 inch (1.27 mm), and a bond spacing of 0.07 inch (1.78 mm), or one that has a bond length of 0.04 inch (1.02 mm), a cut length of 0.09 inch (2.29 mm) and a bond spacing of 0.13 inch (3.30 mm).

Dry basis weight is the basis weight of the wipe before the solution is added to the wipe, i.e., before it is wet.

Wet thickness is the thickness of a wet wipe, i.e., after the solution has been added to it, in mm.

Sheet count is the number of sheets in a roll, i.e., the number of sheets created by the perforations. Although all tests are done under TAPPI standard test conditions, the wet wipes are not equilibrated to those conditions. Instead, the wipes are removed from a sealed container or cartridge and tested within a few, generally less than 5–10, minutes after opening. This is about a 5 minute variation in this time period when the wet wipe is exposed to the atmosphere, which does not materially or significantly alter the test results.

Tensile, stretch and TEA (total energy absorbed) values were obtained on the wet product following ASTM 1117-80, section 7, with the following modifications: sample dimensions were 1+/−0.04 inch (25.4+/−1.0 mm) wide and 4.25+/−0.04 inches (108.0+/−1.0 mm) long; initial gauge length was 3+/−0.04 inches (76.2+/−1.0 mm); test speed is 12 inches/minute (305.0 mm/min).

MD tensile is the peak load before failure per inch width of the sample, as determined in the machine direction. CD tensile is the peak load before failure per inch width of the sample, as determined in the cross direction. MD stretch is the percentage of elongation the wipe has in the machine direction at the peak load. CD stretch is the percentage of elongation of the wipe in the cross machine direction at the peak load. Total Energy Absorbed (TEA) is the area under the force-elongation curve (in units of lb. and ft., respectively) from the start to the failure point divided by the initial surface area of the sample between the upper and lower grips. For these samples, this surface area was 3 sq. inches (19.4 $cm^2$). Ten specimens were tested for each code, and the average was calculated and reported. The test can be carried out on a standard tensile tester such as a MTS Sintech 1/G test machine with TestWorks 3.10 software. Both the Sintech test machine and the TestWorks software are available from MTS Corporation located at 1400 Technology Drive, Eden Prairie, Minn.

Detach refers to the force in grams (g) per sheet that is required to break a perforation, i.e., the amount of force required to separate two sheets in a roll along the perforation. These properties were determined using a MTS Sintech 1/G test machine with TestWorks 3.10 software. Two sheets were removed from a roll. The sheets had a width of 4.25 inches (108.0 mm), and were connected by perforations along the width. The sheets were folded in half along the length such that the width of the sample was 2⅛ inches (54.0 mm). The top and bottom of the sample along substantially the entire width were placed in grips having an internal spacing of 2 inches (50.8 mm), such that the perforation line was centered between the upper and lower grips. The upper grip was then displaced upward (i.e. away from the lower grip) at a rate of 10 inches/minute (254.0 mm/min) until the sample was broken along the perforations. The applied force and sample elongation were measured throughout the test. The peak load from the force-elongation curve is recorded so that the detach strength is expressed as force in units of grams/sheet. The average results from ten samples are reported in Tables I and II, and the average results from three or four samples are reported in Tables IV, V and VI.

Percentage strain at peak load ("% strain @ pk load") was determined from the results of the test described above. The elongation at the peak load is divided by the initial sample length of 2 inches (50.8 mm), and the result is designated the % strain @ peak load. The average results from ten samples are reported.

Wet thickness refers to the thickness of a wipe that is measured while the sample is subjected to a specified load or weight. The wet thickness of wet wipes and wipes before wetting are reported in Table II. These values are based on samples measuring 3×4 inches (76×102 mm) that were individually placed under a confining load of 0.05 pounds/square inch (psi) (345 Pa). The region of the sample that was tested was free of wrinkles and folds. A Starrett Comparator Base Model 653G was used to perform these tests available from Starrett, 121 Crescent St., Athol, Mass. 01331. This base is precision ground to be flat (tolerance of +/−0.001 inch, +/−0.025 mm). A digital displacement indicator (Sony model U30-1 SET) was attached to the base via a cantilevered horizontal control arm supported by a vertical shaft. The indicator measures vertical displacement relative to the comparator base to within 0.001 inch (0.025 mm). The load was applied by an acrylic contact foot attached to a vertically traveling spindle shaft that descended to the comparator base. The foot has a diameter of 3.00 inches (76.2 mm), a height of 0.63 inch (16.0 mm) and is flat on the lower surface to a tolerance of +/−0.001 inch (0.025 mm). The weight of the contact foot, spindle, and the associated hardware, not including the contact force springs in the indicator, is 160.5+/−0.1 g. The spindle shaft descends to the comparator base with a travel time of 0.5 seconds to 0.75 seconds. The thickness was measured by the indicator as the height of the wipe relative to the surface of the comparator base immediately after the load pressure of 0.05 psi (345 Pa) was applied for 3 seconds. Calibration before testing was performed on a set of standard samples traceable to the National Bureau of Standards. By way of example and without limitation, wet wipes useful in the present dispensing system may have a dry basis weight from about 10 to about 200 gsm, a dry thickness from about 0.5 to about 2 mm, a wet (i.e., wipe with solution or wetting material added) thickness from about 0.3 to about 0.7 mm, a MD wet tensile at least about 250 g/inch (9.8 g/mm), a CD wet tensile at least about 200 g/inch (7.9 g/mm), a MD wet stretch from about 5% to about 30%, a CD wet stretch from about 5% to about 36%, a TEA MD wet strength of from about 0.5 to 2 ft-1 b/sq. inch (0.10 to 0.4 J/$cm^2$), a TEA CD wet strength of from about 0.5 to 2 ft-lb/sq. inch (0.10 to 0.4 J/$cm^2$), and a solution add-on of about 100–600%, advantageously of about 150%–350%.

Peel force measures the amount of force in grams/4.25 inches (g/108.0 mm) required to unroll a roll of wet wipes, i.e., the grams required to unroll a roll that is 4.25 inches (108.0 mm) wide. Thus, these values could be normalized to apply to any width roll in grams/inch of roll width basis. The peel force, as reported in Table II was the force required to unroll a roll as it was resting in an open cartridge and was measured with an MTS Sintech 1/G test machine with TestWorks 3.10 software. A 4.5-inch (114.3 mm) wide clamp with rubber surfaces gripped the tail of a roll, with the roll positioned directly underneath the clamp such that the tail would remain vertical as it was unwound from the roll. The clamp was attached to the crosshead, which pulled the tissue web upward at a speed of 100 cm/minute. Peel force was measured by a 50 Newton load cell. The average load to pull 18 to 20 sheets away from the roll was recorded by averaging two runs in which 4 sheets each were separated and two runs in which 5 sheets each were separated. Only the first 18 to 20 sheets from the roll were used to obtain the measurements of Table II.

The dispensing force, which is the force measured in grams force (g) to pull the wet wipes from the dispenser, can also be determined. This force can be measured with a MTS Sintech 1/G test machine equipped with TestWorks 3.10 software. Referring to FIGS. 34 and 35, such a Sintech test machine 290 and dispenser 1 with the roll of wet wipes 34 are representatively shown in cross-sectional view. In FIG. 34 the dispenser is secured in place to platform 294 in a horizontal orientation underneath a clamp 292. The relative orientation of the dispenser to that of the clamp 292 is similar to the way wipes are dispensed from the dispenser during its intended use. The clamp 292 has rubber surfaces which grip substantially the entire width of the tail 36 of the roll of wet wipes 34 placed in the dispenser. For the samples in Tables IV, V and VI, the initial distance 293 between the clamp and the gap of the dispenser is about 8 inches (304.8 mm) and the distance 295 from the middle of clamp 292 to the dispensing gap is about 6 inches (150 mm), such that the distance 297 along the diagonal trajectory of dispensing wipes between the clamp and the gap is about 10 inches (250 mm). The clamp is attached to the crosshead 296, which pulls the roll upward in direction 298 at a speed of 100 cm/mm to a final position as seen in FIG. 35. The angle 299 during dispensing of the wipes from the start of a run until the end should be in the range of angles between about 50° and 80°, but may have to be readily varied to mimic these conditions for the sample dispenser depending on structural features of the actual dispenser used for testing. As concerns the angle 299 compared to the dimensions 293, 295 and 297, it is the angle that controls and not the particular dimensions but rather any proportional dimensions that would still achieve the desired range of angles from 50° to 80° for dispensing wipes pursuant to this dispensing force test. When dispensing the wipes for testing, the dispenser should be lined up with the test clamp so that as the test clamp ascends it pulls wipes out of the dispenser between parallel planes defined by the sides of the dispenser. That is, the wipes will be dispensed out of the dispenser rather evenly between the sides so as to not be biased more toward one side than the other. The pull force is measured by a 50 Newton load cell. For each run, the pull force as a function of pull distance curve for pulling 4 to 5 sheets away from a roll is recorded using the TestWorks 3.10 software. Based on the curve, the peak pull force for each run is calculated. The average peak pull force of three runs is used to represent the dispensing force of a given roll. Only the first 12 to 15 sheets from the roll were used to obtain the measurement, i.e. 4 to 5 new sheets for each run.

Table I sets out types of wet sheets and their properties. In Example 1, the solution was a sufficient amount of commercial (no salt) solution such as that which is used in the commercially available KLEENEX® COTTONELLE® flushable moist wipes product of Kimberly-Clark Corporation. In Example 2, the solution was a sufficient amount of 4% salt water solution such as a simple 4% salt water solution with other additives as disclosed in the examples of wet wipe applications discussed previously in the Background of Invention, all of which have been and are incorporated herein by reference.

TABLE I

| | Non-Dispersible Wet Wipe Example 1 | Dispersible Wet Wipe Example 2 |
|---|---|---|
| Basis Weight | 60 gsm | 60 gsm |
| Solution | commercial (no salt) | 4% salt solution |
| Solution Add on level | 175% | 228% |

TABLE I-continued

| | Non-Dispersible Wet Wipe Example 1 | | Dispersible Wet Wipe Example 2 | |
|---|---|---|---|---|
| Basesheet | 4.25" width | | 4.25" width | |
| Converting | | | | |
| Perforation | 0.11" | | 0.07" | |
| Bond Spacing | | | | |
| | Run Average | Run STDev | Run Average | Run STDev |
| Dry Basis Weight (gsm) | 57 | 2 | 66 | 4 |
| Wet Thickness (mm) | 0.56 | 0.02 | 0.47 | 0.01 |
| Sheet Count | 99 | 0.7 | 99 | 1.1 |
| Wet tensiles | | | | |
| MD Tensile (g/in) | 380 | 26 | 321 | 30 |
| MD Stretch (% Elongation) | 23 | 1.4 | 28 | 1.6 |
| TEA (Ft-Lb/Sq.In) | 0.96 | 0.06 | 1.02 | 0.07 |
| CD Tensile (g/in) | 329 | 28 | 287 | 29 |
| CD Stretch (% Elongation) | 28 | 1.8 | 34 | 3.5 |
| TEA (Ft-Lb/Sq.In) | 0.93 | 0.09 | 0.97 | 0.13 |
| Detach (g/sheet) | 752 | 21 | 853 | 34 |
| % strain @ pk load | 8 | 0.5 | 11 | 1.1 |

Table II contains additional data reflecting the properties of disposable wet wipes. This table shows the effects that changing base sheet and solution variables has on the physical properties of the wipes. The pulp used to make these sheets was Weyerhauser CF 405. For this example, the binder was example Code E, Table 15, of Ser. No. 09/564,531. This binder material had a molecular weight of 610,000 and was made from the following monomers provided in the following weight percents: 60% acrylic acid, 24.5% butacrylic acid, 10.5% 2-ethylhexyl-acrylic acid, and 5% AMPS (2-acrylamido-2-methyl-1-propanesulfonic acid).

TABLE II

| Basesheet Variables | 100% pulp/ 65 gsm 22% binder/1.1 mm dry thickness | 100% pulp/ 60 gsm 20% binder/ .76 mm dry thickness | 100% pulp/ 55 gsm 20% binder/ .76 mm dry thickness | 15% PET/ 55 gsm 20% binder/ .84 mm dry thickness |
|---|---|---|---|---|
| Solutions | | 0.5% silicone; 0.25% lanolin | | |
| | Example 3 | Example 4 | Example 5 | Example 6 |
| MD Wet Tensile (g/1") | 500 | 452 | 383 | 391 |
| CD Wet Tensile (g/1") | 445 | 403 | 344 | 310 |
| wet thickness (mm) | 0.46 | 0.40 | 0.39 | 0.41 |
| peel force | 167 | 131 | 106 | |
| Solutions | | 1.0% silicone; 0.25% lanolin | | |
| | Example 7 | | Example 8 | Example 9 |
| MD Wet Tensile (g/1") | 473 | | 401 | 416 |
| CD Wet Tensile (g//1") | 455 | | 348 | 350 |
| wet thickness (mm) | 0.45 | | 0.40 | 0.39 |
| peel force | 170 | | 120 | 115 |

TABLE II-continued

| Solutions | 1.0% silicone; 0.0% lanolin |
|---|---|
| | Example 10 |
| MD Wet Tensile (g/1") | 528 |
| CD Wet Tensile (g/1") | 462 |
| wet thickness (mm) | 0.44 |
| Peel force | 162 |

Table III sets out the physical properties of rolls of wet wipes made according to the teachings for making wet wipes set forth herein. Tables IV, V and VI set out perforation detach strength data and dispensing force data for sample wet wipes made according to the teachings for making wet wipes set forth herein and for samples of wet wipes which are commercially available products of others, all of which fall within the scope of the present invention.

TABLE III

Coreless Roll Measurements and Calculations

| Roll Number | Measured Diameter (inches) | Unwound Wet Thickness (mm) | Calculated Roll Density (g/cm$^3$) | Calculated Effective Thickness (mm) | Compression Factor (%) |
|---|---|---|---|---|---|
| 1 | 2.77 | NA | 0.621 | 0.340 | 71% |
| 2 | 2.83 | 0.41 | 0.595 | 0.355 | 74% |
| 3 | 2.86 | NA | 0.583 | 0.362 | 76% |
| 4 | 2.90 | NA | 0.567 | 0.373 | 78% |
| 5 | 2.96 | 0.478 | 0.544 | 0.388 | 81% |
| 6 | 2.86 | NA | 0.583 | 0.362 | 76% |
| 7 | 2.98 | NA | 0.537 | 0.393 | 82% |
| 8 | 2.88 | NA | 0.575 | 0.368 | 77% |
| 9 | 2.94 | NA | 0.552 | 0.383 | 80% |
| 10 | 2.86 | 0.448 | 0.583 | 0.362 | 76% |
| 11 | 2.86 | NA | 0.583 | 0.362 | 76% |
| 12 | 2.84 | NA | 0.591 | 0.357 | 74% |
| 13 | 3.00 | NA | 0.530 | 0.399 | 83% |
| 14 | 2.86 | NA | 0.583 | 0.362 | 76% |
| 15 | 2.86 | NA | 0.583 | 0.362 | 76% |

Initial sheet length = 5 inches
Initial sheet width = 4.125 inches
Number of sheets in roll = 90
Dry basesheets basis weight = 65 gsm
Target solution add-on = 225%
Calculated roll weight = 253 grams
Assumed wet thickness prior to winding = 0.48 mm
Compression factor = calculated effective thickness (wound)/assumed wet thickness prior to winding
Calculated Roll Density = weight/$\pi d^2/4$ × width (calculated roll weight/$\pi$ · measured diameter$^2$/4 · initial sheet width)
Calculated Effective Thickness - calculated thickness of sheet in roll under pressure of winding.

TABLE IV

| 35 Durometer Wiper Blade | Sample A | Sample B | Sample C | Sample D |
|---|---|---|---|---|
| Sheet Width in inches (in cm) | 4.125 (10.3 cm) | | 4.250 (10.6 cm) | 3.875 (9.7 cm) |
| Actual Detach Strength (g/sheet) | 919 | | 581 | 390 |
| Actual Dispensing Force (g/sheet) | 210 | (1) | 138 | 121 |
| Detach Strength Characteristic (g/cm) | 89 | | 55 | 40 |
| Dispensing Force Characteristic (g/cm) | 20 | | 13 | 12 |
| Ratio of Detach to Dispensing | 4.38 | | 4.21 | 3.22 |

(1) This product was not tested with the 35 durometer wiper blade.

TABLE V

| 50 Durometer Wiper Blade | Sample A | Sample B | Sample C | Sample D |
|---|---|---|---|---|
| Sheet Width in inches (in cm) | 4.125 (10.3 cm) | 4.125 (10.3 cm) | 4.250 (10.6 cm) | 3.875 (9.7 cm) |
| Actual Detach Strength (g/sheet) | 919 | 1334 | 581 | 390 |
| Actual Dispensing Force (g/sheet) | 255 | 391 | 307 | 278 |
| Detach Strength Characteristic (g/cm) | 89 | 129 | 55 | 40 |
| Dispensing Force Characteristic (g/cm) | 25 | 38 | 29 | 29 |
| Ratio of Detach to Dispensing | 3.60 | 3.41 | 1.89 | 1.40 |

TABLE VI

| 52 Durometer Wiper Blade | Sample A | Sample B | Sample C | Sample D |
|---|---|---|---|---|
| Sheet Width in inches (in cm) | 4.125 (10.3 cm) | 4.125 (10.3 cm) | 4.250 (10.6 cm) | 3.875 (9.7 cm) |
| Actual Detach Strength (g/sheet) | 919 | 1334 | 581 | 390 |
| Actual Dispensing Force (g/sheet) | (2) | 374 | (3) | (4) |
| Detach Strength Characteristic (g/cm) | | 129 | | |
| Dispensing Force Characteristic (g/cm) | | 36 | | |
| Ratio of Detach to Dispensing | | 3.57 | | |

(2) The product was not tested with a 52 durometer wiper blade..
(3) The product did not dispense well, if at all, tended to tear mid-sheet or between sheets so continuous dispensing of multiple sheets throughout test procedure was not possible.
(4) The product did not dispense well, if at all. Tended to tear mid-sheet or between sheets so continuous dispensing of multiple sheets throughout test procedure was not possible.

Referring to Tables IV, V, and VI, Samples A and B are rolls of wet wipes made according to the teachings for making wet wipes set forth herein, and as such, they are similar to the Examples of wet wipes set forth in Tables I, II and III herein for moistened dispersible wet wipes. In particular, without limitation, Sample A had approximately the following properties: 67.6 gsm dry basis weight, 4% salt solution at an add-on of 225% of the dry basis weight, 0.040 inch perforation bond length, 0.090 inch perforation cut length, 0.38 mm wet thickness, 446 g/inch MD Tensile, and 387 g/inch CD Tensile. In particular, without limitation, Sample B had approximately the following properties: 63.7 gsm dry basis weight, 4% salt solution at an add-on of 225% of the dry basis weight, 0.040 inch perforation bond length, 0.090 inch perforation cut length, 0.37 mm wet thickness, 476 g/inch MD Tensile, and 462 g/inch CD Tensile.

Samples C and D are commercially available products of others. Sample C is that known as Moist Mates™ Moist Toilet Tissue on a Roll, sold by Cotton Buds, Inc. of Placentia Calif. USA and obtained by applicants at about August 2000 from Dallas, Tex. Sample D is that known as Fresh & Clean ® wet toilet paper, sold by Sodalco S.p.A. Corsico (Mi) (www.sodalco.it and www.sodalco.com) and obtained by applicants at about September 2000 from Italy.

All Samples A through D were tested in a prototype dispenser for dispensing wet wipes, according to the protocol discussed herein for determining dispensing force. The dispenser was like that seen in FIGS. 1A to 5, inclusive, and the supporting specification, of the prior U.S. patent application of the present assignee titled, "WET WIPES", U.S. Ser. No. 09/659,307 filed Sep. 12, 2000. In particular, without limitation, sample wet wipes were placed in the dispenser and a tail of the sample roll extending out the gap for dispensing. As such, the wiper blade had a thickness along its width (i.e., on either side of fingers 75) of about 0.060 inches and a thickness at fingers 75 of about 0.150 inches. The wiper assembly and blade were configured like that seen and described in FIGS. 24–29 herewith. The wiper blade was found to engage the wet wipes located in the gap, as determined in a direction across the width of the wet wipes, at most locations of the blade. The wiper blade had an overall width greater than the width of the wet wipes and was made of a resilient material known as DynaFlex™ G2755 sold by GLS Corp. of McHenry, Ill., USA and included ½% erucamide wax such as that known by trade name Kemamide™ wax sold by Witco Corp. of Greenwich, Conn., USA, that blooms to the surface during use to lower the initial coefficient of friction between the dispensing wet wipes and the wiper blade. The wiper blade having a hardness of 35 (shore A) durometer had: 285 psi tensile strength, 58 pli tear strength, specific gravity of 0.95 g/cc, and 20% compression set (room temperature only). The wiper blade having a hardness of 50 (shore A) durometer had: 490 psi tensile strength, 120 pli tear strength, specific gravity of 1.18 g/cc, and 22%/40% compression set (room temperature/70° C.). The wiper blade having a hardness of 52 (shore A) durometer had: 615 psi tensile strength, 125 pli tear strength, specific gravity of 0.89 g/cc, and 23%/35% compression set (room temperature/70° C.).

The dispenser and wiper blade were the same for Tables IV, V, and VI, in all regards except for the hardness (as noted in the upper left of each table) and respective related characteristics of the wiper blade recited just-above. The wiper blade described for testing was positioned in the dispenser generally opposite a cartridge positioned like that seen in FIGS. 9, 10, 34 and 35. As such, the front surface of the wiper blade was approximately parallel to the opposite surface of the cartridge, e.g., the lower lip 31 closest to the apex of angle 43 in FIG. 10. Also, the front most surface of ridges 96 (FIG. 32) would be positioned about adjacent the plane defined by a cover of the cartridge and form a space between the ridges and the inside of the cartridge within the lip 31 to allow the wet wipe to pass between the ridges 96 and the cartridge and then adjacent that between the ridges 96 and the wiper blade and the tray 3. As explained herein, the wiper assembly, including wiper blade, could be in various positions depending on various dispensing characteristics desired, and this just happened to be the one used when testing was conducted.

Testing to obtain the relevant values recorded in Tables IV, V, and VI was generally done according to the test procedures and protocol discussed above for Tables I through III. Samples A through D are the same wet wipe product for each of the Tables. In these Tables, the "Actual Detach Strength" is a measure of the force required to separate two sheets joined by a weakened line, e.g., perforations, there between, according to the procedure for determining detach discussed previously, and recorded as grams (g) force per sheet. This value was then normalized based on the width of the sheet, that is grams (g) force per sheet divided by the width of the sheet, to determine the "Detach Strength Characteristic," which is also referred to interchangeably herein as the "Perforation Detach Strength Characteristic." The "Actual Detach Strength" is a measure dependent only upon the wet wipe, i.e., the basesheet properties which can include wetting solution, and not upon any dispenser for the wet wipes. The "Actual Dispensing Force" is a measure of the force required to dispense sheets from a roll of wet wipes out of a dispenser, according to the procedure for determining dispensing force discussed previously, and recorded as grams (g) force per sheet. This value was then normalized based on the width of the sheet, that is grams (g) force per sheet divided by the width of the sheet, to determine the "Dispensing Force Characteristic." The final row in the Tables shows a ratio of the Perforation Detach Strength Characteristic to the Dispensing Force Characteristic, identified in the Tables as "Ratio of Detach to Dispensing." The dispensing force, also called interchangeably herein "actual dispensing force," should be less than the detach force for a roll of perforated wipes. In this way it is better assured that the wipes will be able to be pulled from, or removed from, the dispenser without inadvertently breaking the perforation. Thus, a dispensing force of from about 100 g to about 800 g is contemplated, a dispensing force of from about 150 g to 400 g is further contemplated and ideally a dispensing force of less than 300 g is desirable, with forces normalized based on g/4.25 inches (g/10.8 cm). Normalized, these forces are 23.5 g/inch (9.3 g/cm) to 188.2 g/inch (74.1 g/cm), 35.3 g/inch (13.9 g/cm) to 94.1 g/inch (37.1 g/cm), and 70.6 g/inch (27.8 g/cm). Additionally, the following ranges for the dispensing force characteristic can be advantageous towards enhancing the dispensing of a roll of wet wipes from a dispenser, e.g., the dispensers disclosed herein as well as any others that could be similar in certain regards, in order of increasing advantage: the dispensing force characteristic is greater than 0 g/cm and less than about 75 g/cm, less than about 65 g/cm, less than about 55 g/cm, less than about 45 g/cm, or less than about 35 g/cm.

Opposite of the dispensing force, the detach force, also called interchangeably herein "perforation detach strength" or "actual detach strength," should be greater than the dispensing force for a roll of wipes with weakened lines, e.g., perforations. In this way it is better assured that the wipes will be able to be pulled from, or removed from, the dispenser without inadvertently breaking the perforation while the following wipe is still completely inside the dispenser or before the user desires to disconnect two adjacent wipes externally to the dispenser. Further, by selecting a particular detach force or range of forces, forces that are more user friendly (i.e., one that a human child to an aging adult can pull apart from an adjacent wipe as desired) and/or manufacturing friendly (i.e., flexible in light of possible variability between raw materials) can be chosen to compliment the other dispensing characteristics, all of which individually and collectively can be mixed and matched to enhance a dispensing system as taught herein. Thus, and at least in part depending on the dispensing force, the following ranges for the perforation detach strength characteristic can be advantageous towards enhancing the dispensing of a roll of wet wipes from a dispenser, e.g., the dispensers disclosed herein as well as any others that could be similar in certain regards, in order of increasing advantage: the perforation detach strength characteristic is greater than 55 g/cm, greater than about 60 g/cm, greater than about 65 g/cm, greater than about 75 g/cm, or greater than about 85 g/cm. Additionally, the perforation detach strength characteristic can be any of these and can also advantageously be less than about 150 g/cm.

The applicants have also discovered that the dispensing of wet wipes from a dispenser can be evaluated from the perspective of a ratio of particular dispensing characteristics, rather than just one characteristic or another. This discovery stems, at least in part, from a finding and belief that while certain dispensing characteristics are dependent upon one another, they can also be, to at least some degree, independent of one another. As such, evaluating a ratio of certain characteristics can provide additional and/or different measurements of the cooperation between wet wipes and a dispenser from which they are dispensed, i.e., way to quantify the enhanced dispensing of wipes. One such ratio is that of the perforation detach strength characteristic to the dispensing force characteristic. In order of increasing advantage, this ration can be: greater than 1:1, equal to or greater than about 1.5:1, equal to j or greater than about 2:1, equal to or greater than about 2.5:1, equal to or greater than about 3:1, equal to or greater than about 4:21, equal to or greater than about 5:1, equal to or greater than about 6:1, or equal to or greater than about 7:1.

An example of the dependent/independent nature of certain dispensing characteristics is seen in comparing Table IV to that of Table V. More particularly, comparing the values for Sample A to those for Samples C and D in the respective Tables. One sees that the sheet width and detach force for the Samples is constant throughout the Tables for each Sample, respectively. Notably, although Samples C and D have a lower dispensing force than that of Sample A in Table IV with a 35 durometer wiper blade, Samples C and D have a higher dispensing force than Sample A in Table V with the 50 durometer wiper blade.

Generally a peel force of from 80 g–300 g (per 4.25 inches, 108.0 mm) is contemplated, although lower peel forces may be obtained with different types of wipe products. The cartridge adds minimal resistance to the roll as it is unwound. Thus, the force required to unwind a roll is not materially increased by the cartridge. The roll or stack of wipes may also be placed directly in the tray for dispensing, without the use of a cartridge.

The applicants have discovered that the dispensing of wet wipes from a dispenser can be evaluated from the perspective of yet another dispensing characteristic, referred to herein as the "drag relationship." Table VII sets forth data collected from wet wipes made in accordance with the teachings for making wet wipes herein, and tested in a dispenser the same as that for Samples A and B, but according to the drag relationship test method set forth below.

TABLE VII

| Sample Group | Lubricant Value | Actual Drag Force (grams/sheet) | Drag Relationship (%) |
|---|---|---|---|
| 1 | 0 | 483.8 | 0 |
| 2 | 25 | 348.9 | 27.9 |
| 3 | 50 | 319.5 | 34.0 |
| 4 | 75 | 285.0 | 41.1 |
| 5 | 100 | 264.1 | 45.4 |
| 6 | 150 | 251.1 | 48.1 |
| 7 | 300 | 245.4 | 49.3 |

Sample Wet Wipes

For Table VII, test samples were first prepared that are representative of wet wipes of the invention. The basesheet for the test samples was prepared generally as taught in the pending US application entitled, "ION-SENSITIVE, WATER DISPERSIBLE POLYMERS, AND METHOD OF MAKING SAME AND ITEMS USING SAME," Ser. No. 09/564,449 filed May 4,2000, which is incorporated herein by reference, except as noted hereafter. A 65 gsm substrate containing 22% binder was prepared on a commercial airlaid machine having a DanWeb airlaid former using two forming heads. Weyerhaeuser CF405 bleached softwood kraft fiber in roll pulp form was used and fiberized with hammermills, then formed into a 50.7 gsm airlaid web on the moving wire. The newly formed web was densified by heated compaction rolls and transferred to a second wire, where the web was further densified by a second heated compaction roll. The web was then transferred and uniformly sprayed on the top side with ion-sensitive polymer formulation mixture on the exposed surface of the web, applying half of the ion-sensitive polymer formulation solids (7.2 gsm) relative to the dry fiber mass of the finished substrate weight. The ion-sensitive polymer formulation mixture comprised water as the carrier with 15% binder solids, wherein the binder comprised 75% SSB-6 as the ion-sensitive polymer formulation and 25% Dur-O-SET® RB (National Starch) as the co-binder polymer. After the web was sprayed, it was carried into an oven to dry the binder solution. The web then was transferred onto another wire and the underside of the sheet uniformly sprayed with the ion sensitive polymer formulation. The remaining half of the ion sensitive polymer formulation solids (7.2 gsm) relative to dry fiber mass of the finished substrate weight was applied. After the second binder application, the web was again carried into an oven to dry the newly applied binder solution. The air temperature in the ovens was approximately 190° C. to 205° C. The average basis weight of the web after drying was 65.1 gsm. The average thickness of the dry web was 0.86 mm. The machine direction dry tensile (MDDT) strength of the web was measured at 2468 g/1" with a MD dry stretch of 9.7%.

A wetting composition in an amount sufficient for what is needed for testing was prepared by combining the following ingredients according to the specific weight percent: 93.16 weight percent deionized water, 4 weight percent Top-Flo Evaporated Salt, 1 weight percent Mackstat H-66 preservative (McIntyre Group, Chicago, Ill.), 1 weight percent Sodium Cocoyl Gluatamate anionic surfactant (Hampshire Chemical, Nashua, N.H.), 0.42 weight percent DC-1785 silicone emulsion (Dow Corning, Midland Mich.), 0.1 weight percent Firmenich fragrance (Firmenich, Inc. Princeton, N.J.) 0.25 weight percent polysorbate 20, and about 0.08 weight percent of 50 percent by weight malic acid solution to bring the pH to 5.0. Other wetting composition batches were prepared to arrive at the various lubricant values noted in Table VII, and these were identical to the just mentioned wetting solution except that the amount of lubricant is a percent of the original level of lubricant in the wetting solution, and a corresponding manipulation of the amount of water to balance the total amount of ingredients. For example, the following lubricant values correspond to the needed lubricant-water amounts (i.e., in this format—lubricant value=weight percent DC-1785 silicone emulsion & weight percent deionized water): 0=0 & 93.570; 25=0.105 & 93.465; 50=0.210 & 93.360; 75=0.315 & 93.255; 100=0.42 & 93.160; 150=0.630 & 92.940; and 300=1.260 & 92.310.

The dried web was cut into 4 inch (cross direction of the sheet "CD") by 6 inch (machine direction of the sheet "MD") pieces. A stack of five (dry) basesheet samples were weighed and weights recorded. The prepared wetting solution was gently rotated or agitated by hand in its container for at least one minute. At least 50 milliliters of the wetting solution was poured in a beaker having a magnetic stir bar. The solution was stirred for five minutes at room temperature using a Model 4658 Stirrer/Hot Plate (Cole-Parmer). The stirred solution was poured onto the stack (five) of basesheet samples. Using a stainless steel tube, the stack was rolled across the top to remove excess fluid until 250% add-on was achieved (e.g., if a stack of five sheets weighed 5.15 grams, 250% add-on would be 12.875 grams (5.15×2.5), and the total weight of the five wetted basesheet samples would be 18.025 grams (5.15+12.875)). The stack of basesheet samples was then placed in a Ziplock™ bag sealed shut until time of testing. The samples were allow to equilibrate in TAPPI standard conditions for a period of time between about 30 minutes and 24 hours.

Drag Relationship Test Method

For Table VII, the drag force or Actual Drag Force, is the force measured in grams force (g) to pull the wet wipes samples from the dispenser per the steps outlined below. This force can be measured with a MTS Sintech 1/G test machine equipped with TestWorks 3.10 software or comparable equipment. Referring to FIG. 34, such a Sintech test machine 290 and dispenser 1 are seen. The drag force testing is conducted similar to that for dispensing force testing discussed earlier, except as noted hereafter. As in FIG. 34, the dispenser for the drag force test is secured in place to platform 294 in a horizontal orientation, but now with the orifice or opening of the dispenser directly underneath the clamp 292 and not off at an angle like the dispenser in FIGS. 34 and 35. In this way, for the drag force test when the wet wipes samples are dispensed during testing, they will ascend vertically upward in a substantially straight direction out of the sealing orifice or opening of the dispenser (i.e., and perpendicular to the base of the test machine 290. The same dispenser should be used for each sample tested. The sealing orifice (e.g., here the wiper blade) is cleaned thoroughly using isopropyl alcohol wipes (e.g. those from Kendall Healthcare Products Company, a division of the Kendall Company, Mansfield, Mass. 02048) before each different sample group is tested.

The clamp 292 is lowered until it will rest about ¼ inch away from the front of the dispenser secured directly underneath the clamp when beginning to test each sample. The first of the 5 prepared samples is loosely placed into the inside chamber of the dispenser and about a 2 inch tail is made to stick out of the sealing orifice when the lid of the dispenser is closed. The sample will be dispensed in the 6 inch MD of the sheet. As such, the clamp 292, having rubber surfaces, grips substantially the entire width of the tail (i.e., the 4 inch CD) of the sample placed in the dispenser. The clamp is attached to the crosshead 296, which pulls the sample vertically upward in direction 298 at a speed of 100 cm/min until the entire sheet is pulled out of the dispenser. Also, when dispensing the samples for testing, the dispenser should be lined up with the test clamp so that as the test clamp ascends it pulls wipes out of the dispenser between parallel planes defined by the sides of the dispenser. That is, the wipes will be dispensed out of the dispenser rather evenly between the sides so as to not be biased more toward one side than the other.

The pull force is measured by a 100 Newton load cell made by MTS, part number 4501008/B. For each run, the pull force as a function of the pull distance curve for pulling one of five similarly prepared sample sheets completely out of the dispenser is recorded using the TestWorks 3.10 software. Based on the curve, the peak drag force for each run is calculated. The average peak drag force of the 5 runs, which is recorded as Actual Drag Force, is used to represent the drag force of a group of 5 similarly prepared samples. The Drag Relationship or drag relationship is calculated as the value that the Actual Drag Force for a particular Sample Group is less than the Actual Drag Force for Sample Group 1 (i.e., which is the sample Group without any lubricant) expressed as a percentage value. For example, for Sample Group 3 the Drag Relationship is 34.0% which means that the Actual Drag Force of Sample Group 3 is 34.0% less than the Actual Drag Force of Sample Group 1. (483.8−319.5)/483.8×100=34.0%)

The present invention contemplates a test for drag force that can be used to analyze a variety of forms of wet wipes dispensed from a variety of dispensers. As such, then, the drag relationship is not wet wipes or dispenser specific but rather, is dependent upon the desired features in the wet wipes dispensing system. Such a system can include a plurality of separably joined wet wipes, such as a roll of wet wipes separated by weakened lines (e.g., perforations). The plurality of separably joined wet wipes can include a lubricant as defined herein. The system can further include a dispenser. Examples of dispensers are seen throughout the accompanying figures and described herein, as well as can be seen in pending U.S. applications entitled "FLEXIBLE ORIFICE FOR WET WIPES DISPENSERS," Ser. No. 09/870,785 filed May 31, 2001 or "WET WIPE CONTAINER WITH FLEXIBLE ORIFICE," Ser. No. 09/538,711 filed Mar. 30, 2000, both assigned to the present applicant and both incorporated herein by reference.

Dispensers of the invention can include a sealed chamber, the sealed chamber housing the plurality of separably joined wet wipes therein. The sealed chamber is generally defined by the perimeter of the housing and access inside the chamber is substantially prevented, or at least reduced, except at a flexible elastic sealing orifice. The dispenser can include a flexible elastic sealing orifice through which wet wipes from the plurality of separably joined wet wipes can be dispensed from the sealed chamber. As seen in the accompanying figures, this is the wiper blade 10/74 (e.g., FIGS. 9, 30 and 31) in combination with the adjacent lip 31 of the cartridge or tray of the dispenser. Examples of flexible elastic sealing orifices are also seen in the pending US applications entitled FLEXIBLE ORIFICE FOR WET WIPES DISPENSERS, and WET WIPE CONTAINER WITH FLEXIBLE ORIFICE, just mentioned. The flexible elastic sealing orifice can seal the wet wipes with a space no greater than, and in order of increasing advantage, 3 mm, 2 mm, 1 mm, 0.5 mm, 0.25 mm or about 0 mm, as such space is defined by the maximum width of the opening formed between any two opposing cooperating parts of the flexible elastic sealing orifice (e.g., slit 340 defined between sides 352 in FIGS. 41–45) or between the flexible elastic sealing orifice and a cooperating part of the dispenser (e.g., the space between the wiper blade 10 and cartridge lip 31 in FIG. 9).

The system can further include, during dispensing, at least a portion of the lubricant being automatically transferable, or even transferred, to the flexible elastic sealing orifice when wet wipes from the plurality of separably joined wet wipes are dispensed from the sealed chamber through the flexible elastic sealing orifice. In this way, the system can include a drag relationship between the wet wipes and the flexible elastic sealing orifice which is reduced by at least about 20%. Still further, the system can include, and in order of increasing advantage, the drag relationship between the wet wipes and the flexible elastic sealing orifice being reduced by at least about 30%, by at least about 40%, by at least about 50%, or by at least about 60%.

Other aspects of the invention also aid the drag relationship. For example, it is believed that although any lubricant as lubricant is defined herein can be used with the invention, certain lubricants can exhibit favorable features in light of the wet wipes environment. Lubricants that are also non-volatile, that also adsorb to the flexible elastic sealing orifice, or that also are water immiscible, further enhance or maintain the drag relationship by being more readily maintained in place on the flexible elastic sealing orifice.

In another aspect, the invention provides a method for dispensing a plurality of wet wipes. This can be advantageously done upon a single occasion of dispensing, if desired. In this way, the dispensing of wet wipes from a stack or roll of wet wipes can be more like the dispensing dry toilet tissue, with a habit and in a manner to which consumers are accustomed. A single occasion of dispensing generally means with a single pull of the leading wet wipe sticking out of the dispenser, such that at least two wet wipes, and advantageously as many more as a user desires, are dispensed sequentially with the same pull. As soon as the desired number of separably joined wet wipes are dispensed from the dispenser, the user can then separate the dispensed wet wipes from the wet wipes remaining at least partially within the dispenser.

The dispensing of a plurality of wet wipes first involves providing a plurality of separably joined wipes moistened with a solution containing a lubricant, the moistened wipes thereby comprising wet wipes. This can be accomplished by any of a variety of means as taught herein. Next, the plurality of separably joined wipes can be stored in the dispenser. Then, when desired, a plurality of wet wipes can be dispensed from the plurality of separably joined wipes upon a single occasion through a flexible elastic sealing orifice of the dispenser. Next, when dispensing the plurality of wet wipes there can be automatic lubricating of the orifice of the dispenser with the lubricant. In this way, through the combined actions of dispensing wet wipes and lubricating the orifice there can be a reduction of the a drag relationship between the plurality of wet wipes and the flexible elastic sealing orifice by at least about 20%. Other reductions in the drag relationship, as well as use of particular lubricants, can be performed similar to the discussion for the dispensing system noted above.

FIG. 9 shows the roll 34 as it is placed in a cartridge in a dispenser. The spiral line 38 is intended to represent the manner in which the roll is wound and depicts in that configuration a roll that is being unwound from the bottom. The use of a cartridge is not necessary, although it or a similar structure for retaining moisture in the roll and/or providing a place for excess moisture to collect. FIG. 9 further shows a relationship for the wiper 10 to the wet web.

FIG. 10 shows a portion of a cartridge 11, the lip 31 of the cartridge, and the side walls 39 and 40. The angle at which the cartridge is positioned has an effect on how well the dispenser will perform. The angle will have a tendency to increase or reduce the drag associated with pulling the wipe out. It will have an effect on the amount of siphoning, wicking or drying that may take place in the wet wipe. It may also have an effect on how the roll acts as it is unwound, becoming smaller and smaller in the cartridge. The angle of the cartridge can be measured by the angle that the lip 31 forms with a true vertical axis, shown as 42. For a dispenser system as shown in FIGS. 1–9, the angle 43 that the lip 31 has with a true vertical axis 42 should be from about 10 degrees to about 80 degrees, from about 20 degrees to about 70 degrees, at least greater than 20 degrees, at least smaller than 60 degrees, and advantageously about 30 degrees.

Further the angle may be selected such that it balances the forces between the peel forces associated with unrolling the roll and the weight of the roll forcing it down. Thus the wipe can be unrolled without having excessive movement of the roll within the cartridge, which in turn overcomes the tendency of the roll to translate toward the gap and bind or jam the dispenser. Additionally, the selection of the angle may play a role in reducing the drying of the wet wipe. As the angle 43 is increased the difference between the height of the top of the roll and the tail is decreased, thus decreasing any siphoning driving force.

Figure 13:
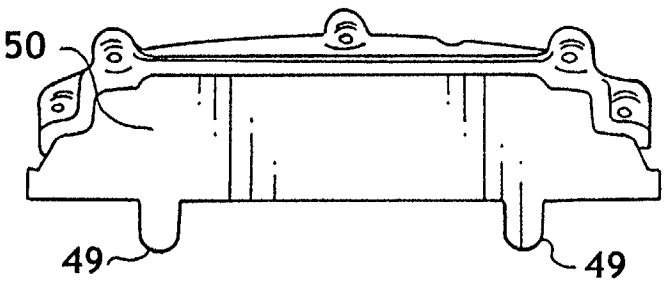
Figure 16:
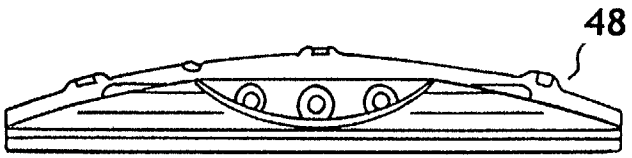

FIGS. 12 through 16 show two examples of a wiper assembly or wiper 10. FIG. 12 shows a back plan view of one wiper assembly. FIG. 13 shows a front plan view of the assembly of FIG. 12. and FIG. 12A shows a cross section of FIG. 12 taken at A—A. FIG. 16 shows a back plan view of an alternative wiper assembly. FIG. 14 shows a top plan view of the assembly of FIG. 16. and FIG. 15 shows a cross section of FIG. 14 taken at A—A. In this example the wiper assembly 10 comprises a chassis 48, and a blade 50 that has fingers 49. In this example the fingers are designed to cooperate with the lowered surfaces 16*b* (FIG. 2A) of the guides on the housing. In this example the blade is made of SANTOPRENE® and the chassis is made of polypropylene.

FIGS. 17 and 18 show an example of a wiper blade. In this example the wiper blade is formed of a single piece (see FIG. 17) of material that is folded over to form the wiper blade (see FIG. 18). The wiper blade has raised portions 51 that reduce the amount of surface area of the wiper blade that contacts the sheet and raised areas 53 and lowered areas 52 that cooperate with the raised and lowered areas of the guides.

FIGS. 19 through 23 show another example of a wiper or wiper assembly 10. FIG. 19 is a back plan view of the assembly and FIG. 20 is a front plan view. FIG. 21 is a back plan view of the wiper blade for use in the assembly of FIG. 19. FIG. 22 is an end view of FIG. 21 and FIG. 23 is a back perspective view of FIG. 21. In this example the wiper assembly comprises a chassis 73, and a wiper blade 74 (74*a* shows sections of blade engaging and protruding through the chassis) that has fingers 75. In this example the fingers are designed to cooperate with the lowered surfaces of the guides 16 in the dispenser. In this example the blade is made of SANTOPRENE® and the chassis is made of polypropylene. This example contains raised or thicker areas 97 of the wiper. These raised areas cooperate with the guides 16 on the tray.

FIGS. 24 through 29 show an example of another wiper assembly. In this example the wiper assembly comprises a chassis 73, and a wiper blade 74 (74*a* shows sections of blade engaging and protruding through the chassis) that has fingers 75. FIG. 24 is a back plan view of the assembly. FIG. 25 is a cross section taken at A—A of FIG. 25 and FIG. 26 is a cross section taken at B—B of FIG. 24. FIG. 27 is a back-bottom perspective view of the assembly of FIG. 24. FIG. 28 is a back-top perspective view of the assembly of FIG. 24. FIG. 29 is a front-top perspective of the assembly of FIG. 24. In this example the fingers are designed to cooperate with the lowered surfaces of the guides 16 in the dispenser. In this example the blade is made of SANTOPRENE® and the chassis is made of polypropylene. This embodiment contains raised or thicker areas 97 of the wiper. These raised areas cooperate with the guides 16 on the tray. This example also includes rounded ridges 96, similar in structure and function to those described in FIG. 32 below.

Wiper blades can be made out of any flexible or resilient material, such as thermoplastic elastomers, foam, sponge, plastic, or rubber having a Shore A durometer hardness value ranging from about 0 to 80 (as determined according to ASTM D 2240). In combination with the other teachings herein, the applicants have discovered that a dispensing characteristic is attributable to the hardness of the wiper blade. As such, this characteristic in combination with one or more of the others can enhance the dispensing of a roll of wet wipes. Thus, the following ranges for the wiper blade hardness, in Shore A durometer, can be advantageous towards enhancing the dispensing of a roll of wet wipes from a dispenser, e.g., the dispensers disclosed herein as well as any others that could be similar in certain regards, in order of increasing advantage: the wiper blade has a Shore A hardness equal to or less than about 80 durometer, equal to or less than about 70 durometer, equal to or less than about 60 durometer, equal to or less than about 50 durometer, equal to or less than about 45 durometer, equal to or less than about 40 durometer, or equal to or less than about 30 durometer. Also, the wiper blade advantageously has a Shore A hardness which can be any of these and also advantageously is no less than about 25 durometer.

The wiper blades can be made from a material that will form a good moisture and contamination barrier. Examples of some materials are SANTOPRENE®, Kraton®, silicone, or styrene ethylene/butylene styrene (SEBS). The wiper blade is designed to function with the guides and the tray and to a limited extent the lip of the cartridge. Depending on the placement of the wiper, it could have greater or lesser interaction with these components of the dispensing system. The space between the end of the wiper blade and the tray may be varied depending upon the thickness of the wet wipes and how much drag is need for the dispensing system to function as desired. The wiper blade can help to hold the tail of the wipe in place and thus keep the tail from falling back through the space and into the cartridge.

The wiper blade can have various physical properties. For example, the material can have a Gurley stiffness value (ASTM D 6125-97) between about 100 mg and 8000 mg, advantageously between about 200 mg and 6000 mg, and more advantageously between about 400 mg and 3000 mg. The wiper blade can have a tensile strength (ASTM D 412) between about 100 psi and about 1000 psi and more advantageously between about 400 psi and about 700 psi. The wiper blade can have a tear strength (ASTM D 624) between about 30 pli and about 300 pli and more advantageously between about 50 pli and about 150 pli. The wiper blade can have compression set (ASTM 395 B) between about 5% and about 30% (room temperature) and more advantageously between about 10% and about 25% (room temperature), and 10% to 100% (at 70° C.) and more advantageously between about 20% and about 50% (at 70° C.). The wiper blade can have a specific gravity (ASTM D 792) between about 0.70 g/cc and 1.40 g/cc and more advantageously between about 0.85 g/cc and 1.20 g/cc. The wiper blade can have an elastic modulus value (measured by 300% modulus (ASTM D 412)) between 50 psi and 1000 psi, more advantageously between 200 psi and 800 psi, and even more advantageously between 300 psi and 500 psi. The wiper blade can also be designed to exert force onto a wipe across substantially the entire length of the wiper blade at least during dispensing, and even some force not during dispensing to assist in better sealing the chamber with wipes therein from the environment outside the chamber. The wiper blade can have 1/16% to 1% of Kemamide™ wax that can bloom to the surface during use to lower the initial coefficient of friction between the wiper blade and the wipes during dispensing. Such an available material for making a wiper blade having these various properties is know as DynaFlex™ G 2755 sold by GLS Corporation of McHenry, Ill., USA.

The force applied to the wipe by the wiper blade when pulling the wipe from the dispenser should not be greater than the tensile strength of the wipe in the non-perforated region and not greater than the perforation tensile strength of a perforated wipe. If the wipes are made such that they are dry in storage and become wet during use, the blade may be configured to exert pressure on the wipe. In this case, the dispensing of a sheet or sheets causes sufficient shear to be applied to the wipe to permit the moisture to be released. For example, this force or shear may be sufficient to cause microcapsules of fluid to burst or may be sufficient to rupture a protective emulsion which contains the fluid.

FIGS. 30 to 32 illustrate dispensers 1 that have a rounded member 95 or rounded ridges 96. These components are shown as being part of or attached to the wiper blade assembly 99 and adjacent the wiper blade 74. These components prevent or reduce the tendency of the roll from binding in the space as the size of the roll decreases.

FIG. 33 illustrates a conventional holder 85 with the roller removed and a mounting assembly 8 engaged with the post 86. In actual use the mounting assembly would be joined with a dispenser, as shown for example in FIG. 2, and the dispenser would thereby be mounted to the holder 85. Alternative mountings may also be employed. These mountings may be fixed or removable. They may include by way of example such fastening systems as cable ties, wing nuts, anchor bolts, click and grooves and snap and lock mechanisms.

Referring to FIGS. 36–38, there are depicted additional wet wipes dispensing systems of the invention, including various wet wipes dispensers 310, 310', and 310" having a flexible elastic sealing orifice 320 for pop-up style dispensing of wet wipes. A rigid port 312 can be positioned adjacent an end portion 314 of the dispenser 310. The rigid port 312 surrounds a flexible, rubber-like sheet 322 having a top surface 324 and a bottom surface 326 (FIGS. 39–44). A continuous slit 340 extends across the top and bottom surfaces 324, 326 of the sheet 322 and between the surfaces 324, 326 so that a wet wipe in a stack of wet wipes 316 can pass from the bottom surface 326 to the top surface 324 or from the top surface to the bottom surface. As seen in FIGS. 40–45, a first portion 328 or surrounding portion 328 of the sheet can have a first thickness. A second portion 332 of the sheet located between the continuous slit 340 and the first portion 328 can have a second thickness which is greater than or less than the first thickness.

With reference to FIGS. 40–45 the second portion 332 can be located adjacent the continuous slit 340. The second portion can be located on one side of the slit 340 or on both opposing sides of the continuous slit. The second portion 332 can extend along only a portion of the continuous slit or its entire length. The continuous slit can have one or more curved portions such as a first curved portion 344 and a second curved portion 348. The first curved portion can have a first orientation relative to a longitudinal axis 342 of the continuous slit. The second curved portion can have a second orientation relative to the longitudinal axis 342. The first orientation can be different than the second orientation, and particularly, the first orientation can be an inverse of the second orientation relative to the longitudinal axis of the slit 342. The continuous slit 340 can have an orientation pattern along its length of A-B-A, such as the convex-concave-convex pattern seen in FIG. 45 relative to the longitudinal axis 342. More particularly, the continuous slit 340 can have an orientation pattern approximating that of a sine wave. The continuous slit can form two sides 352 substantially uniformly spaced apart from each other along the continuous slit. More particularly, the two sides 352 can be spaced apart from each other by a distance equal to or less than about 20 mils.

With reference to FIGS. 42–45, in one aspect of the invention the flexible orifice has at least one hinge 356 located between the continuous slit 340 and a surrounding portion 328 of the sheet 322. In this way, the side 352 of the sheet adjacent the continuous slit can pivot relative to the surrounding portion of the sheet via the hinge. The hinge 356 is formed by any structural deformation or recess that creates a stress release zone for flexing of a portion of the sheet 322, e.g., the side or sides 352, at the hinge or hinges 356 relative to the adjacent portion of the sheet. A hinge 356 can be located adjacent the continuous slit on opposing sides 352 of the continuous slit. Also, the hinge can extend along the entire slit 340 or only a portion of the continuous slit.

With reference to FIGS. 36–38, a variety of particular characteristics can be employed to achieve a desired dispensing force for the flexible orifice. Often, this is dependent upon the configuration of the continuous slit and configuration of the flexible, rubber-like sheet, as well as the material properties of the flexible, rubber-like sheet and material characteristics of the wet wipes being dispensed (e.g., fiber composition, formation process, bulk, density, thickness, weight, CD tensile, MD tensile and type of separably joined relationship between adjacent wipes in a stack of wipes). Some examples are now discussed to help guide practice of the invention and without limitation to the specifics set forth. For example, the rigid port can have a longitudinal axis (e.g., the long axis of the oval) with a length of about 10% to about 95% of the width of a wet wipe, and more particularly of about 60% to about 90% of the width of a wet wipe. In a similar regard, the rigid port can have a lateral axis (e.g., the short axis of the oval) with a length of about 10% to about 90% of the length of the longitudinal axis, and more particularly of about 30% to about 60% of the length of the longitudinal axis.

Referring specifically to FIG. 45, other examples are discussed. The length 354 of the continuous slit can be from about 20% to about 90% of the width of a wipe and more particularly from about 40% to about 70% of the width of a wipe. The width of the second portion 332 of each side 352 of the slit can be about 1/16 inch to about ½ inch and more particularly from about ⅛ inch to about inch. The length of the second portion 332 can be about 10% to about 95% of the length 354 of the orifice and more particularly about 60% to about 80% of the length 354. The thickness of the first portion 328 or surrounding portion 328 can be about 20 mil to about 110 mil and more particularly about 35 mil to about 60 mil, e.g., about 50 mil. The thickness of the second portion 332 can be about 20% to about 90% of the thickness of the first portion 328, e.g., about 40 mil. The thickness at the end of continuous slit 340 at the zone 334 (e.g., seen in FIG. 40) can be about 100% to about 300% of the thickness of the first portion 328.

In an effort to quantify the properties of the flexible rubber-like sheet 322, the relevant material properties can be described in terms of the hardness, stiffness, thickness, elasticity, specific gravity, compression set, and any combination thereof. More specifically, the Shore A hardness (as measured by ASTM D2240) of the flexible, rubber-like sheet or material can be about 100 or less, more specifically from about 20 to about 90, and still more specifically from about 40 to about 80, and yet more specifically from about 60 to about 70. The Gurley stiffness of the flexible, rubber-like sheet or material (as measured by ASTM D 6125-97"Standard Test Method for Bending Resistance of Paper and Paperboard") can be about 10,000 milligrams of force (mgf) or less, more specifically from about 100 to about 8000 mgf, more specifically from about 200 to about 6500 mgf, and still more specifically from about 300 to about 1500 mgf. The thickness of the flexible, rubber-like sheet can be about 10 mil or greater, more specifically from about 10 mil to about 110 mil, and still more specifically from about 35 mil to about 60 mil. The elasticity of the flexible rubber-like material or sheet, as characterized by the elastic modulus value (measured by 300% modulus (ASTM D 412)), can be between 50 psi and 1000 psi, more advantageously between 200 psi and 800 psi, and even more advantageously between 300 psi and 500 psi. The flexible rubber-like sheet can have a specific gravity (per ASTM D792) of about 0.80 to 1.21, more specifically 0.88 to about 1.10, and still more specifically from about 0.90 to about 1.0. The flexible rubber-like sheet can have a compression set (per ASTM 395B) of (at room temperature/at 70 degrees C.) about 8/30 to 40/120 and more specifically 15/45 to about 28/100.

An example of some such flexible sheet-like materials include thermoplastic elastomeric (TPE) materials that can be used to provide acceptable dispensing. Materials which can be employed include (but are not limited to): any of the family of styrenic-based TPE's (i.e. styrenic block copolymer compounds); styrenic-based TPE's containing rubber modifiers such as Kraton™, Santoprene™, or other rubber modifiers; Kraton™,;Santoprene™; specialty copolymers, such as ethylene-methyl acrylate copolymers (e.g. EMAC™ of the Eastman Chemical Company); thermoset rubbers; polyurethane; alloys; amides; engineering TPE's; olefinic-based; olefinic vulcanizates; polyester-based; polyurethane-based. One such material for the flexible, rubber-like sheet could be that manufactured by the GLS Corporation of McHenry, Ill., USA and known as resin #G2701. The G2701 material is one of the resins in the product family of TPEs. G2701 is a styrenic-based material and is in the family of Styrenic block copolymer compounds. Some particular properties of the G2701 can be: specific gravity of 0.090 g/cc (per ASTM D792); hardness (Shore A durometer) of 68 (ASTM D2240); and compression set of 24% at room temperature, 96% at 70 deg. C. (per ASTM 395B). Another similar material is known as G2755 and also sold by GLS Corporation. In addition, a lubricant (e.g., wax) can be added to lower the coefficient of friction of the continuous slit which can benefit injection molding, wet wipes dispensing, and physical handling of the flexible orifice. The G2701 TPE resin with ¼% wax additive sold by GLS Corporation and known as #LC217-189 can be used.

FIGS. 36 and 37 show wet wipe dispensers of the present invention having rigid plastic containers. FIG. 38 shows a wet wipes dispenser having a flexible container (e.g., a form, fill seal type of film container) with a rigid port member attached thereto. Each dispenser includes a top hingedly attached adjacent an end portion of the dispenser. In FIGS. 36 and 37, the dispensers have a removable cover which contains the rigid port 312 which surrounds the flexible, rubber-like sheet 322. The cover can be fixedly or removably secured to the sidewalls of the base. For each dispenser in FIGS. 36–39, the top is secured in a closed position by a suitable latching mechanism. The shape of the rigid port in the dispensers shown in FIGS. 36 and 37 is oval and in FIG. 38 rectangular, but such port (i.e., and thus the flexible orifice contained within the port 312) can be any shape and size large enough to enable some clearance between the ends of the continuous slit and the rigid port so as to not interfere with the dispensing function of the flexible orifice.

In use, the top of the dispenser is opened and then access to the flexible elastic sealing orifice is gained. The user then passes his or her hand, etc., through the continuous slit 340 to grab the first wipe in the stack of wipes 316. If the flexible elastic sealing orifice has a frangible seal, this must be broken before the user can pass his or her hand through the sealing orifice. Once the user grabs the wipe, it can then pass through the sealing orifice and out of the dispenser as the user pulls it up. If the user does not immediately need the wipe, it can be left in the orifice partially dispensed where it can be maintained in place by the continuous slit until desired later. The partially dispensed wipe will just rest in place in the sealing orifice, part inside the dispenser and part in the space between the top and the flexible elastic sealing orifice, conveniently ready for later dispensing in the pop-up format. If the user does immediately desire to use the wipe, it can pass the complete wipe through the continuous slit and out of the dispenser. For pop-up dispensing, the wipe will become separated or disjointed from the subsequent adjacent second wipe at a separably joined interface (e.g., weakened line, adhesive joint, or other mechanism) after fully dispensing the first wipe and while a portion of the second wipe remains in the sealing orifice 320. The next wipe for dispensing may be automatically maintained in the orifice partially dispensed for later use (i.e., in a pop-up dispensing format). Alternatively, the following wipe may need to be fetched out of the inside of the dispenser similar to the first wipe at a later time when it is desired, commonly called reach-in dispensing, if the user pushed the following wipe back into the storage portion after pop-up dispensing of the leading wipe. In either case, after the desired number of wipes are taken, the top can be closed, with or without a wipe partially dispensed in the sealing orifice, as discussed previously. At a later time when another wipe(s) is desired, the preceding steps can generally be followed again.

All publications, patents, and patent documents cited in the specification are incorporated by reference herein, as though individually incorporated by reference. In the case of any inconsistencies, the present disclosure, including any definitions herein, will prevail. While the invention has been described in detail with respect to the specific aspects thereof, it will be appreciated that those skilled in the art, upon attaining an understanding of the foregoing, may readily conceive of alterations to, variations of, and equivalents to these aspects which fall within the spirit and scope of the present invention, which should be assessed accordingly to that of the appended claims.

What is claimed is:

1. A wet wipes dispensing system comprising:

a plurality of separably joined wet wipes, the plurality of separably joined wet wipes comprising a lubricant;

a dispenser comprising a sealed chamber, the sealed chamber housing the plurality of separably joined wet wipes therein; and the dispenser comprising a rigid port surrounding a flexible elastic sealing orifice through which wet wipes from the plurality of separably joined wet wipes can be dispensed from the sealed chamber, the flexible elastic sealing orifice sealing the rigid port and comprising a continuous slit, wherein at least a portion of the lubricant is automatically transferable to the flexible elastic sealing orifice when wet wipes from the plurality of separably joined wet wipes are dispensed from the sealed chamber through the continuous slit whereby a drag relationship between the wet wipes and the flexible elastic sealing orifice is reduced by at least about 20% when compared to wet wipes not containing a lubricant dispensed from the dispenser.

2. The wet wipes dispensing system of claim 1 wherein the lubricant is non-volatile.

3. The wet wipes dispensing system of claim 1 wherein the lubricant adsorbs to the flexible elastic sealing orifice.

4. The wet wipes dispensing system of claim 1 wherein the lubricant is water immiscible.

5. The wet wipes dispensing system of claim 1 wherein the plurality of wet wipes comprise a roll of wet wipes.

6. The wet wipes dispensing system of claim 1 wherein the drag relationship between the wet wipes and the flexible elastic sealing orifice is reduced by at least about 30%.

7. The wet wipes dispensing system of claim 1 wherein the drag relationship between the wet wipes and the flexible elastic sealing orifice is reduced by at least about 40%.

8. The wet wipes dispensing system of claim 1 wherein the drag relationship between the wet wipes and the flexible elastic sealing orifice is reduced by at least about 50%.

9. The wet wipes dispensing system of claim 1 wherein the drag relationship between the wet wipes and the flexible elastic sealing orifice is reduced by at least about 60%.

10. The wet wipes dispensing system of claim 1 wherein the continuous slit comprises a space no greater than about 3 mm through which the wet wipes are dispensed.

11. The wet wipes dispensing system of claim 1 wherein the continuous slit comprises a space no greater than about 2 mm through which the wet wipes are dispensed.

12. The wet wipes dispensing system of claim 1 wherein the continuous slit comprises a space no greater than about 1 mm through which the wet wipes are dispensed.

13. The wet wipes dispensing system of claim 1 wherein the continuous slit comprises a space no greater than about 0.5 mm through which the wet wipes are dispensed.

14. The wet wipes dispensing system of claim 1 wherein the continuous slit comprises a space no greater than about 0.25 mm through which the wet wipes are dispensed.

15. The wet wipes dispensing system of claim 1 wherein the continuous slit comprises an initial space of about 0 mm which is flexed open to allow the wet wipes to be dispensed.

16. The wet wipes dispensing system of claim 1, 6, 7, 8, 9, 10, 12, or 15 wherein the lubricant comprises silicone.

17. The wet wipes dispensing system of claim 1 wherein the continuous silt comprises a first curved portion and a second curved portion.

18. The wet wipes dispensing system of claim 17 wherein the first curved portion has a first orientation relative to a longitudinal axis of the continuous silt and the second curved portion has a second orientation relative to the longitudinal axis.

19. The wet wipes dispensing system of claim 18 wherein the continuous slit approximates a sine wave.

20. The wet wipes dispensing system of claim 1 wherein the plurality of wet wipes comprise a stack of wet wipes.

21. The wet wipes dispensing system of claim 1 wherein the flexible elastic sealing orifice comprises a rubber-like sheet having a Shore A hardness from about 20 to about 90.

22. The wet wipes dispensing system of claim 1 wherein the flexible elastic sealing orifice comprises a rubber-like sheet having a Gurley stiffness from about 200 to about 6500 mgf.

23. The wet wipes dispensing system of claim 1 wherein the flexible elastic sealing orifice comprises a rubber-like sheet having a thickness from about 10 mil to about 110 mil.

24. The wet wipes dispensing system of claim 1 wherein the flexible elastic sealing orifice comprises a rubber-like sheet having an elastic modulus between 200 psi and 800 psi.

25. The wet wipes dispensing system of claim 1 wherein the flexible elastic sealing orifice comprises a rubber-like sheet having a specific gravity 0.88 to about 1.10.

26. The wet wipes dispensing system of claim 1 wherein the flexible elastic sealing orifice comprises a rubber-like sheet having compression set about 8/30 to 40/120.

27. The wet wipes dispensing system of claim 1 wherein the continuous slit comprises a length from about 20% to about 90% of the width of the wet wipes.

28. The wet wipes dispensing system of claim 1 wherein the continuous slit comprises a length from about 40% to about 70% of the width of the wet wipes.

* * * * *